US007984979B2

(12) United States Patent
Umeda

(10) Patent No.: US 7,984,979 B2
(45) Date of Patent: Jul. 26, 2011

(54) LIQUID EJECTING DEVICE

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 409 days.

(21) Appl. No.: 12/197,933

(22) Filed: Aug. 25, 2008

(65) Prior Publication Data

US 2009/0058907 A1 Mar. 5, 2009

(30) Foreign Application Priority Data

Aug. 28, 2007 (JP) ..... 2007-221147

(51) Int. Cl.
*B41J 2/175* (2006.01)
*B41J 2/19* (2006.01)

(52) U.S. Cl. ..... 347/85; 347/92

(58) Field of Classification Search ..... 347/29, 347/30, 36, 85, 92
See application file for complete search history.

(56) References Cited

U.S. PATENT DOCUMENTS

2007/0046747 A1* 3/2007 Takemoto ..... 347/92

FOREIGN PATENT DOCUMENTS

JP 2005-288770 A 10/2005

* cited by examiner

*Primary Examiner* — Geoffrey Mruk
(74) *Attorney, Agent, or Firm* — Baker Botts L.L.P.

(57) ABSTRACT

A liquid ejecting device including a liquid ejecting head for ejecting a liquid; a liquid supply channel to supply the liquid to the liquid ejecting head; a discharge channel connected to the liquid supply channel through a gas permeable film to discharge a gas in the liquid supply channel; a suction unit connected to the discharge channel and configured to suction a gas in the discharge channel to reduce a pressure therein; a switching unit configured to block the communication of the discharge channel with the suction unit when the gas in the discharge channel is not suctioned; and a discharge detecting unit configured to detect that the gas in the liquid supply channel is suctioned and discharged to the discharge channel by the reduced pressure in the discharge channel when the communication of the discharge channel with the suction unit is blocked by the switching unit.

16 Claims, 16 Drawing Sheets

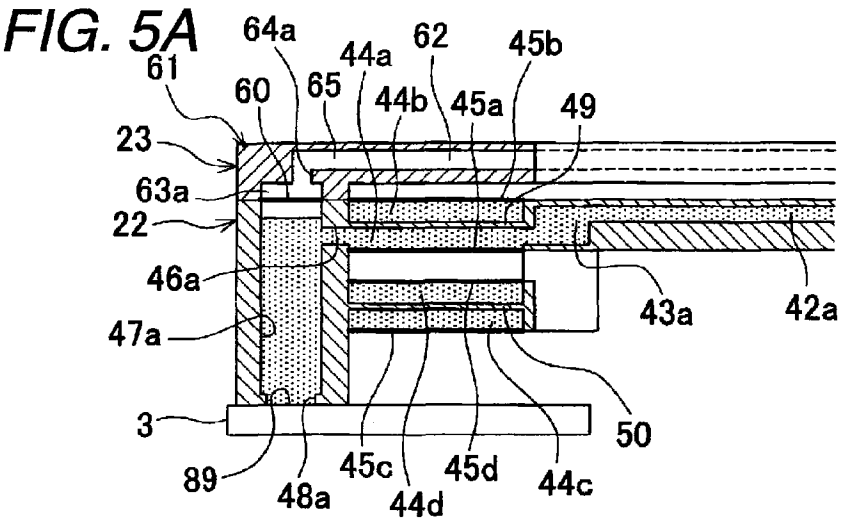
FIG. 5A
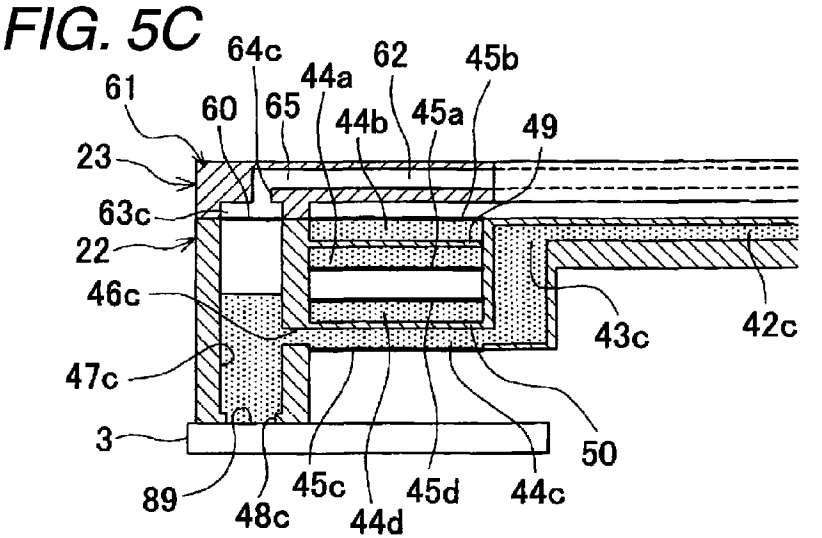
FIG. 5C
FIG. 5B
FIG. 5D

LIQUID EJECTING DEVICE

CROSS-REFERENCE TO RELATED APPLICATION

This application claims priority from Japanese Patent Application No. 2007-221147, filed on Aug. 28, 2007, the entire subject matter of which is incorporated herein by reference.

TECHNICAL FIELD

Aspects of the present invention relate to a liquid ejecting device ejecting a liquid from nozzles.

BACKGROUND

JP-A-2005-288770 describes an ink-jet printing device in which a sub-tank containing ink to be supplied to a print head is partitioned vertically by a ventilation film, a part below the ventilation film serves as an ink chamber containing ink, and a part above the ventilation film serves as an air chamber to which air in the ink chamber is discharged. The air chamber is connected to a deaeration pump with a valve interposed therebetween, and the air in the air chamber and the ink chamber is discharged externally by actuating the deaeration pump with the valve opened to suction the air in the air chamber. By closing the valve after suctioning the air in the air chamber by actuating the deaeration pump, the air chamber is maintained in reduced pressure and then the air flowing in the ink chamber is discharged to the air chamber due to the reduced pressure of the air chamber. Accordingly, it is possible to prevent the air from flowing into the print head together with the ink at the time of supplying the ink from the ink chamber to the print head.

In the ink-jet printing device described in JP-A-2005-288770, when the air in the ink chamber is discharged to the air chamber, the ink in the ink chamber and the print head communicating with the ink chamber varies in pressure and thus meniscuses of nozzles vibrate or the like. Accordingly, when the ink is ejected from the print head in this state, an ink ejection characteristic may vary. However, when the air chamber is maintained in reduced pressure, the air reaching the vicinity of the ventilation film is discharged from the ink chamber to the air chamber, and therefore, it can not be detected when the air is discharged. As a result, the ink may be ejected from the nozzles at the same time when air is being discharged from the ink chamber to the air chamber.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a liquid ejecting device which is able to detect that a gas in a liquid supply channel is being discharged to a discharge channel by detecting a reduced pressure in the discharge channel.

According to an exemplary embodiment of the present invention, there is provided a liquid ejecting device including: a liquid ejecting head including a nozzle for ejecting a liquid; a liquid supply channel connected to the liquid ejecting head to supply the liquid to the liquid ejecting head; a discharge channel connected to the liquid supply channel through a connecting portion to discharge a gas in the liquid supply channel; a gas permeable film disposed in the connecting portion between the liquid supply channel and the discharge channel, the gas permeable film configured to pass the gas and do not pass the liquid, the gas permeable film partitioning the liquid supply channel and the discharge channel; a suction unit connected to the discharge channel to communicate therewith and configured to suction a gas in the discharge channel to reduce a pressure therein; a switching unit configured to block the communication of the discharge channel with the suction unit when the gas in the discharge channel is not suctioned by the suction unit; and a discharge detecting unit configured to detect that the gas in the liquid supply channel is suctioned and discharged to the discharge channel by the reduced pressure in the discharge channel when the communication of the discharge channel with the suction unit is blocked by the switching unit.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 5A is a sectional view taken along line A-A of FIG. 4, FIG. 5B is a sectional view taken along line B-B of FIG. 4, FIG. 5C is a sectional view taken along line C-C of FIG. 4, and FIG. 5D is a sectional view taken along line D-D of FIG. 4;

DETAILED DESCRIPTION

Hereinafter, exemplary embodiments of the present invention will be described.

Figure 1:
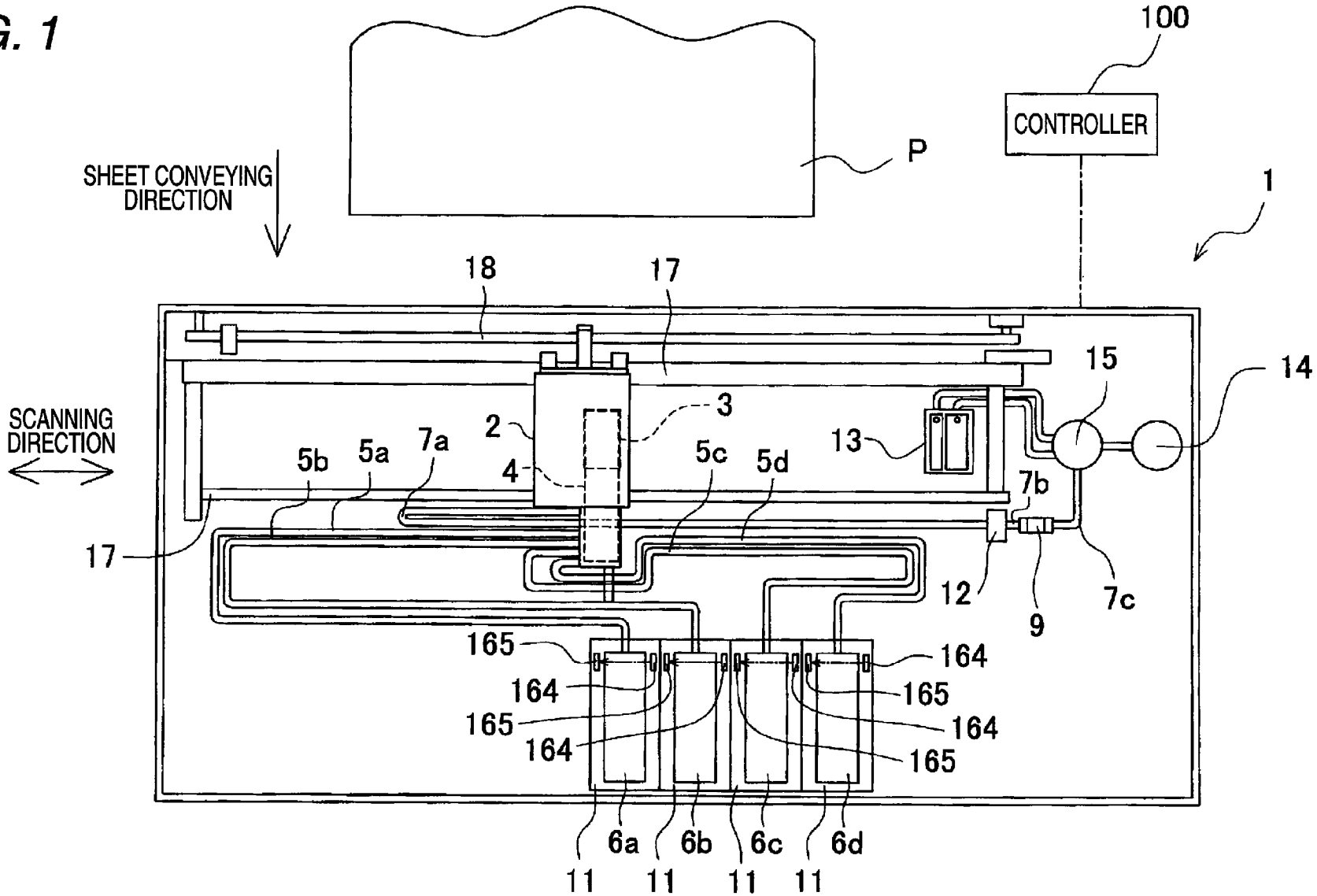
FIG. 1 is a diagram schematically illustrating a configuration of a printer according to an exemplary embodiment of the invention.

FIG. 1 is a diagram schematically illustrating a configuration of a printer according to an exemplary embodiment of the invention. As shown in FIG. 1, the printer 1 includes a carriage 2, an ink-jet head 3, a sub-tank 4, four cartridge mounting sections 11, tubes 5*a* to 5*d*, tubes 7*a* to 7*d*, a differential pressure regulating valve 9, a charge tank 12, an ink suction cap 13, a suction pump 14, and a switching unit 15. The operation of the printer 1 is controlled by a controller 100.

The carriage 2 is driven by a driving mechanism 18 and reciprocates in a scanning direction along two guide shafts 17 extending in parallel in the horizontal direction (scanning direction) of FIG. 1. The ink-jet head 3 is mounted on the carriage 2 and ejects ink (liquid) onto a printing sheet P conveyed to the down side in FIG. 1 (in a sheet conveying direction) by a sheet conveying mechanism not shown from nozzles 95 (see FIG. 6) disposed on the bottom surface thereof while reciprocating in the scanning direction along with the carriage 2. Accordingly, an image is printed onto the printing sheet P.

The sub-tank 4 is mounted on the carriage 2 and ink to be supplied to the ink-jet head 3 is temporarily contained in the sub-tank 4. Four cartridge mounting sections 11 are arranged in the horizontal direction in FIG. 1 and ink cartridges 6*a* to 6*d* are detachably mounted on the cartridge mounting sections 11, respectively, sequentially from the left of FIG. 1. Ink of black, yellow, cyan, and magenta to be supplied to the ink-jet head 3 is contained in the ink cartridges 6*a* to 6*d*, respectively.

The tubes 5*a* to 5*d* have one end connected to the sub-tank 4 and the other end connected to ink flow channel 162 (described later) of the corresponding cartridge mounting sections 11, respectively. Four colors of ink contained in the ink cartridges 6*a* to 6*d* mounted on the cartridge mounting sections 11 are supplied to the sub-tank 4 through the ink flow channels 162 and the tubes 5*a* to 5*b*, respectively. Accordingly, four colors of ink are supplied from the sub-tank 4 to the ink-jet head 3 and four colors of ink is ejected from the nozzles 95 (see FIG. 6).

The tube 7*a* connects the sub-tank 4 and the charge tank 12, the tube 7*b* connects the charge tank 12 and the differential pressure regulating valve 9, and the tube 7*c* connects the differential pressure regulating valve 9 and the switching unit 15. Accordingly, the sub-tank 4 and the switching unit 15 are connected through the tubes 7*a* to 7*c*, the charge tank 12, and the differential pressure regulating valve 9. A gas flow channel extending from a discharge unit 23 (see FIG. 3, described later) of the sub-tank 4 to the switching unit 15 through the tubes 7*a* to 7*c*, the charge tank 12, and the differential pressure regulating valve 9 corresponds to the discharge channel.

As described later, the differential pressure regulating valve 9 switches the communication states (communicating state or communication blocked state) between the tube 7*a* and the tube 7*b*. As described later, when a portion of the discharge channel between the sub-tank 4 and the differential pressure regulating valve 9 is maintained in a negative pressure, the charge tank 12 serves to elongate the duration of the negative pressure.

The ink suction cap 13 is disposed to face the bottom surface of the ink-jet head 3 when the carriage 2 is located at the most right position of FIG. 1 in a movable range of the carriage 2, and moves in a direction departing forward from the paper surface of FIG. 1 to cover the nozzles 95 formed in the bottom surface of the ink-jet head 3 when the ink-jet head 3 is located at the position facing the ink suction cap 13. The ink suction cap 13 is connected to the switching unit 15.

The suction pump 14 is connected to the switching unit 15. The switching unit 15 selectively connects the suction pump 14 to one of the tube 7*c* and the ink suction cap 13. By actuating the suction pump 14 in the state where the suction pump 14 is connected to the tube 7*c* by the switching unit 15, it is possible to suction the gas in the discharge channel from the tube 7*c*. In addition, by actuating the suction pump 14 in the state where the suction pump 14 and the ink suction cap 13 are connected to each other by the switching unit 15, it is possible to suction the thickened ink in the ink-jet head 3 from the nozzles 95 (see FIG. 6).

The cartridge mounting sections 11 and the ink cartridges 6*a* to 6*d* mounted on the cartridge mounting sections 11 will be described in detail. Since the ink cartridges 6*a* to 6*d* have the same configuration except that the ink contained therein is different in color, only the ink cartridge 6*a* will be described below and the ink cartridges 6*b* to 6*d* will not be described below.

Figure 2A:
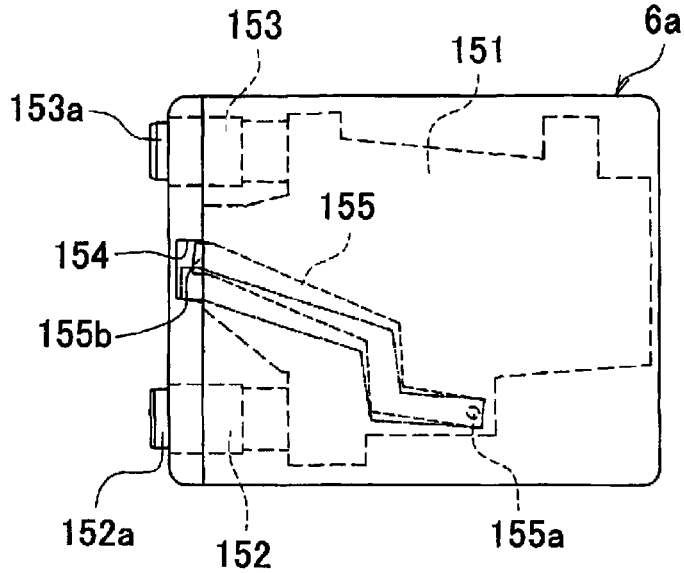
FIG. 2A is a side view illustrating an ink cartridge shown in FIG. 1
Figure 2B:
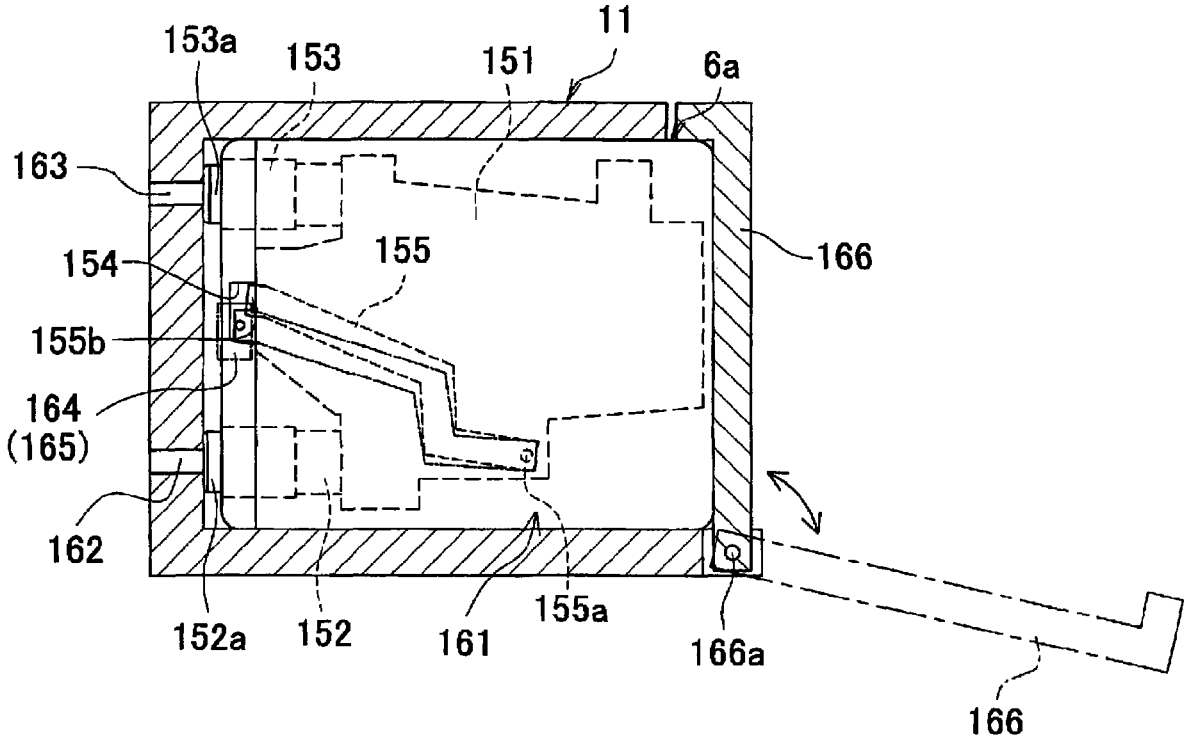
FIG. 2B is a diagram illustrating a state where the ink cartridge is mounted on a cartridge mounting section.

FIG. 2A is a side view of the ink cartridge 6*a* shown in FIG. 1 and FIG. 2B is a diagram illustrating a state where the ink cartridge 6*a* shown in FIG. 2A is mounted on the cartridge mounting section 11. As shown in FIGS. 2A and 2B, the ink cartridge 6*a* has a substantially rectangular parallelepiped shape and includes an ink containing chamber 151, an ink supply port 152, and a gas inlet port 153.

The ink containing chamber 151 is a space for containing ink and is formed in the ink cartridge 6*a*. The left end of the ink containing chamber 151 in FIG. 2A is a light transmitting portion 154 that can transmit light in the direction perpendicular to the paper surface of FIG. 2A and 2B. A near-empty detecting lever 155 is disposed in the ink containing chamber 151.

The near-empty detecting lever 155 is rotatably supported by a supporting portion 155*a* disposed in the lower end portion of the ink containing chamber 151, is bent two times in the middle way from the supporting portion 155*a*, and extends to the upper left side up to the light transmitting portion 154. The front end of the near-empty detecting lever 155 extending up to the light transmitting portion 154 serves as a light blocking portion 155*b* blocking light passing through the light transmitting portion 154. The near-empty detecting lever 155 is made of a material having a specific gravity smaller than that of the ink in the ink containing chamber 151 and rotates about the supporting portion 155*a* with a variation in liquid level of the ink contained in the ink containing chamber 151 by the buoyancy from the ink. The light blocking portion 155*b* moves vertically with the rotation.

The ink supply port 152 is disposed at the lower-left end of the ink cartridge 6*a* in FIG. 2A. The right end of the ink supply port 152 in FIG. 2A is connected to the ink containing chamber 151, the ink supply port 152 extends to the left side surface of the ink cartridge 6*a* in FIG. 2A in the left direction of the drawing from the connecting portion of the ink containing chamber 151, and the left end thereof in FIG. 2A serves as an ink supply hole 152*a* supplying the ink in the ink containing chamber 151. A valve and the like (not shown) is disposed in the ink supply port 152 and the ink containing chamber 151 and the ink supply hole 152*a* are made to communicate with each other only when the ink cartridge 6*a* is mounted on the cartridge mounting section 11.

The gas inlet port 153 is disposed at the upper-left end of the ink cartridge 6*a* in FIG. 2A. The right end of the gas inlet port 153 in FIG. 2A is connected to the ink containing chamber 151, the gas inlet port extends to the left side surface of the ink cartridge 6*a* in FIG. 2A in the left direction of the drawing from the connecting portion of the ink containing chamber 151, and the left end thereof in FIG. 2A serves as a gas inlet hole 153*a* supplying a gas (air) into the ink containing chamber 151. A valve and the like (not shown) is disposed in the gas inlet port 153 and the ink containing chamber 151 and the gas inlet hole 153*a* are made to communicate with each other only when the ink cartridge 6*a* is mounted on the cartridge mounting section 11.

The cartridge mounting section 11 includes a cartridge mounting space 161, an ink flow channel 162, a gas inlet channel 163, a light emitting portion 164, a light receiving portion 165, and a lid 166. The cartridge mounting space 161 is a space in which the left side in FIG. 2B is opened and on which the ink cartridge 6*a* is mounted. As shown in FIG. 2B, by inserting the ink cartridge 6*a* from the right opening in FIG. 2B with a posture where the side surface on which the ink supply hole 152*a* and the gas inlet hole 153*a* are formed faces the left in FIG. 2B and the ink supply hole 152*a* and the gas inlet hole 153*a* are disposed vertically in this order from the upside, the ink cartridge 6*a* is inserted into the cartridge mounting space 161.

The ink flow channel 162 is disposed substantially at the same height as the ink supply hole 152*a* of the ink cartridge 6*a* inserted into the cartridge mounting space 161 in a wall defining the left wall of the cartridge mounting space 161 in FIG. 2B, and the left end thereof in FIG. 2B is connected to the tube 5*a*. When the ink cartridge 6*a* is inserted into the cartridge mounting space 161, the ink supply hole 152*a* and the ink flow channel 162 communicate with each other and the ink containing chamber 151 and the ink supply hole 152*a* communicate with each other as described above. Accordingly, the ink in the ink containing chamber 151 flows in the tube 5*a* through the ink supply port 152 and the ink flow channel 162.

The gas inlet channel 163 is disposed substantially at the same height as the gas inlet hole 153*a* of the ink cartridge 6*a* inserted into the cartridge mounting space 161, in the wall defining the left wall of the cartridge mounting space 161 in FIG. 2B, and the opposite end of the cartridge mounting space 161 communicates with the external air. When the ink cartridge 6*a* is inserted into the cartridge mounting space 161, the gas inlet hole 153*a* and the gas inlet channel 163 communicate with each other and the ink containing chamber 151 and the gas inlet hole 153*a* communicate with each other as described above. Accordingly, when the ink in the ink containing chamber 151 flows in the tube 5*a* through the ink flow channel 162, the external air (gas) is supplied into the ink containing chamber 151 from the outside through the gas inlet channel 163 and the gas inlet port 153 as much as the flowing ink.

The light emitting portion 164 and the light receiving portion 165 is disposed at the position overlapping the light transmitting portion 154 of the ink cartridge 6*a* inserted into the cartridge mounting space 161 in the direction perpendicular to the paper surface of FIGS. 2A and 2B with the light transmitting portion 154 interposed therebetween. The light emitting portion 164 emits light to the light receiving portion 165. The light receiving portion 165 receives the light emitted from the light emitting portion 164.

In the state where the ink cartridge 6*a* is inserted into the cartridge mounting space 161, when the ink remaining in the ink containing chamber 151 is sufficient and thus the light blocking portion 155*b* of the near-empty detecting lever 155 is located above the light emitting portion 164 and the light receiving portion 165, the light emitted from the light emitting portion 164 is not blocked by the light blocking portion 155*b* and reaches the light receiving portion 165. Thus, the light receiving portion 165 receives the light.

On the other hand, when the amount of ink remaining in the ink containing chamber 151 is smaller than a predetermined amount and thus the light blocking portion 155*b* is located at the same height as the light emitting portion 164 and the light receiving portion 165, the light emitted from the light emitting portion 164 is blocked by the light blocking portion 155*b* and does not reach the light receiving portion 165. Thus, the light receiving portion 165 does not receive the light. As a result, by detecting whether the light receiving portion 165 receives the light, it is possible to detect whether the amount of ink remaining in the ink containing chamber 151 of the ink cartridge 6*a* is smaller than the predetermined amount. Since the near-empty detecting lever 155 comes in contact with the wall surface lower than the light transmitting portion 154 at that time, the light blocking portion 155*b* does not move down any more even with a further decrease of the amount of ink remaining in the ink containing chamber 151.

The lid 166 is rotatably supported by a supporting portion 166*a* disposed at the lower-right end of the cartridge mounting section 11 in FIG. 2B and extends from one end in the vicinity of the supporting portion 166*a* to the other end substantially along a straight line. When the ink cartridge 6*a* is inserted into the cartridge mounting space 161, the ink cartridge 6*a* is inserted from the opening of the cartridge mounting space 161 as described above in the state where the lid 166 is made to rotate to the position indicated by a dot chained line in FIG. 2B. After the insertion of the ink cartridge 6*a* into the cartridge mounting space 161 is completed, the lid 166 is made to move to the position indicated by a solid line in FIG. 2B to close the opening of the cartridge mounting space 161. At this time, the ink cartridge 6*a* is pressed to the left side in FIG. 2B by the lid 166. Accordingly, the ink supply port 152 and the ink flow channel 162 come in close contact with each other and the gas inlet hole 153*a* and the gas inlet channel 163 come in close contact with each other.

The cartridge mounting section 11 further includes a cartridge insertion detecting sensor 167 (see FIG. 12) detecting whether the ink cartridge 6*a* is inserted into the cartridge mounting space 161. The cartridge insertion detecting sensor 167 is not shown in FIG. 2B.

Figure 3:
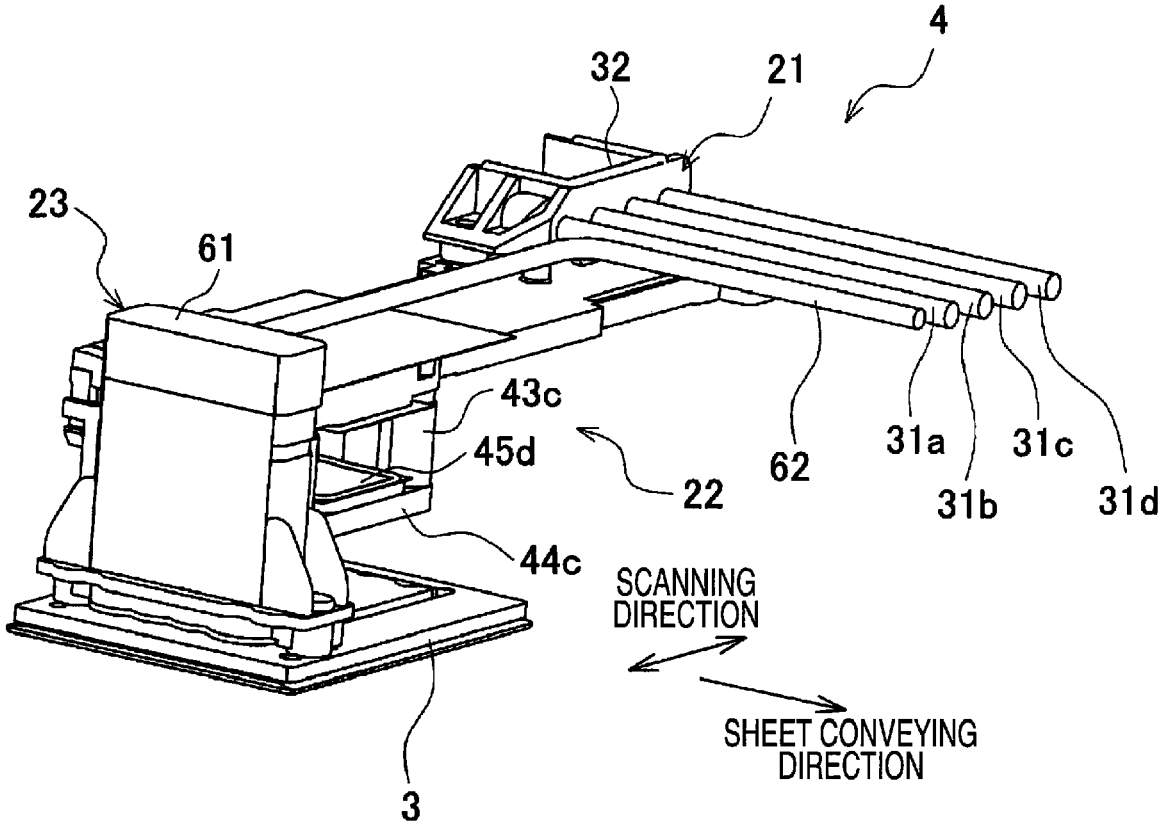
FIG. 3 is a perspective view schematically illustrating a sub-tank shown in FIG. 1.
Figure 4:
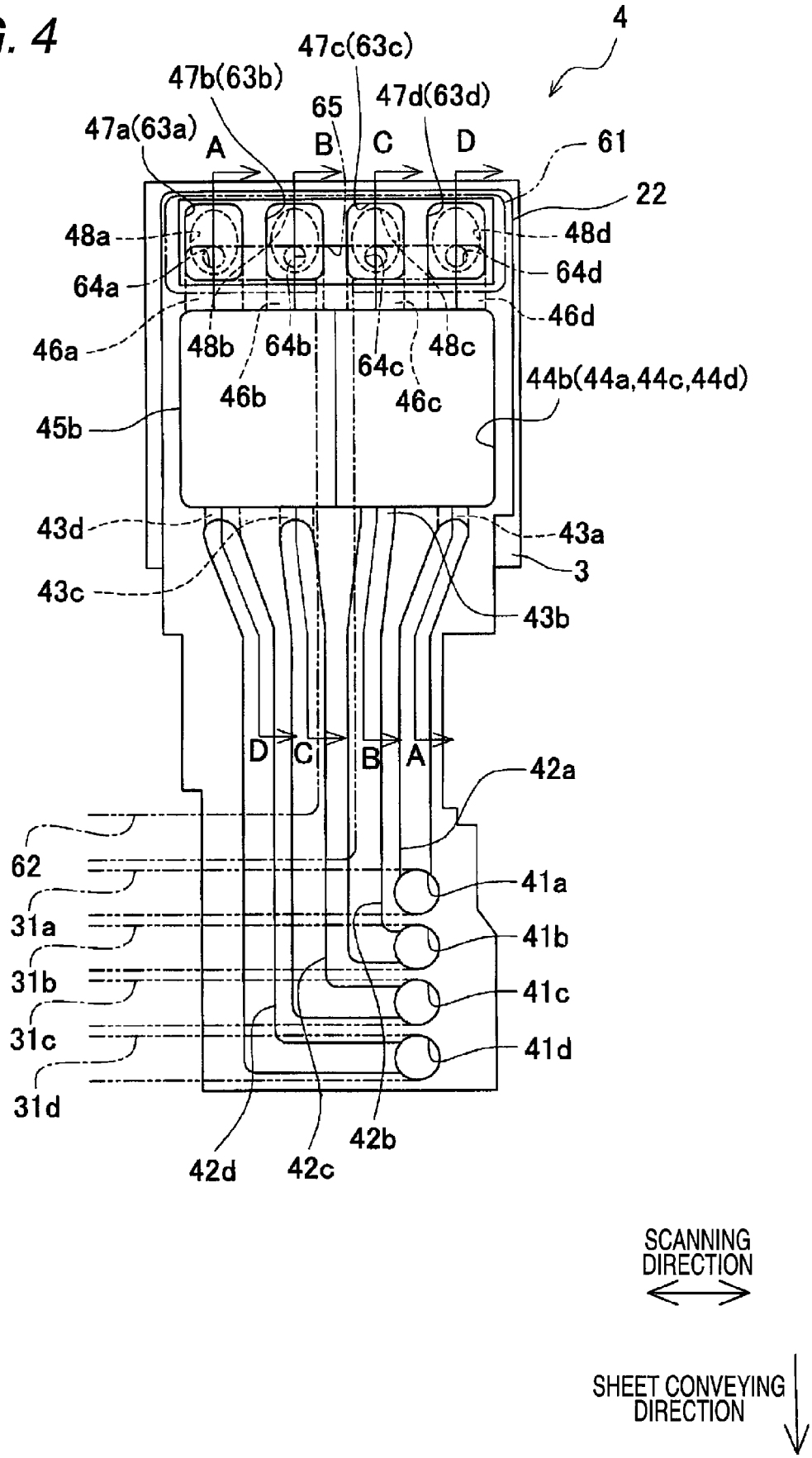
FIG. 4 is a plan view of the sub-tank shown in FIG. 3.

The sub-tank 4 is described now. FIG. 3 is a perspective view schematically illustrating the sub-tank 4 shown in FIG. 1. FIG. 4 is a plan view of FIG. 3. FIG. 5A is a sectional view taken along line A-A of FIG. 4. FIG. 5B is a sectional view taken along line B-B of FIG. 4. FIG. 5C is a sectional view taken along line C-C of FIG. 4. FIG. 5D is a sectional view taken along line D-D of FIG. 4. For the purpose of easily understanding the drawings, in FIG. 4, inflow tubes 31*a* to 31*d* of a connection unit 21 (described later) and a discharge unit 23 (described later) are indicated by a two-dot chained line, and parts of a connecting portion 32 of the connection unit 21 and a sub-tank body 22 are not shown. As shown in FIGS. 3 to 5D, the sub-tank 4 includes a connection unit 21, a sub-tank body 22, and a discharge unit 23.

The connection unit 21 serves to connect the tubes 5*a* to 5*d* to the sub-tank 4 and includes inflow tubes 31*a* to 31*d* and a connecting portion 32. The inflow tubes 31*a* to 31*d* are cylindrical tubes extending in the sheet conveying direction in parallel to each other and are arranged in the scanning direction with a constant interval. The front ends of the inflow tubes 31*a* to 31*d* in FIG. 3 are connected to the tubes 5*a* to 5*d* (the tubes 5*a* to 5*d* are not shown in FIGS. 3 and 4) and the deep-side ends thereof in FIG. 3 are connected to the connecting portion 32. The connecting portion 32 is bonded to the top surface of one end in the scanning direction of the sub-tank body 22 to allow the inflow tubes 31*a* to 31*d* to communicate with connection holes 41*a* to 41*d* of the sub-tank body 22 (described later).

The sub-tank body 22 includes connection holes 41*a* to 41*d*, ink flow channels 42*a* to 42*d*, 43*a* to 43*d*, 46*a* to 46*d*, and 47*a* to 47*d*, ink containing chambers 44*a* to 44*d*, and damper films 45*a* to 45*d*. The connection holes 41*a* to 41*d* have a substantially circular shape in a plan view and are arranged in the vertical direction of FIG. 3 at the lower-right end of the sub-tank body 22 in FIG. 3. The sub-tank body 22 is supplied with the ink from the connection holes 41*a* to 41*d*.

The ink flow channel 42*a* extends to the upside of FIG. 4 from the connection hole 41*a*, is bent to the upper-right side of FIG. 4 in the middle way, and extends to the position of the ink containing chambers 44*a* to 44*d* in the vicinity of the downside in FIG. 4.

The ink flow channel 42*b* extends to the left side of FIG. 4 from the connection hole 41*b*, is bent upward in the drawing in the middle way, is bent again to the upper-right side of FIG. 4 in the middle way, and extends to the position of the ink containing chambers 44*a* to 44*d* in the vicinity of the downside in FIG. 4.

The ink flow channel 42*c* extends to the left side of FIG. 4 from the connection hole 41*c*, is bent upward in the drawing in the middle way, is bent again to the upper-left side of FIG. 4 in the middle way, and extends to the position of the ink containing chambers 44*a* to 44*d* in the vicinity of the downside in FIG. 4.

The ink flow channel 42*d* extends to the left side of FIG. 4 from the connection hole 41*d*, is bent upward in the drawing in the middle way, is bent again to the upper-left side of FIG. 4 in the middle way, and extends to the position of the ink containing chambers 44*a* to 44*d* in the vicinity of the downside in FIG. 4.

By arranging the ink flow channels 42*a* to 42*d* as described above, the portions extending to the upside and the downside of FIG. 4 are arranged in the horizontal direction of FIG. 4 in the order of the ink flow channels 42*a*, 42*b*, 42*c*, and 42*d* from the right side.

The ink containing chambers 44*a* to 44*d* are arranged at positions of the ink flow channels 42*a* to 42*d* in the vicinity of the upper end in FIG. 4 so as to overlap with each other in the plan view. The ink containing chambers 44*b*, 44*a*, 44*d*, and 44*c* are sequentially arranged in this order in the vertical direction as shown in FIGS. 5A to 5D. The ink containing chambers 44*a* to 44*d* have a substantially rectangular longitudinally extending in the horizontal direction of FIG. 4 in the plan view.

The upper surface of the ink containing chamber 44*b* and the lower surface of the ink containing chamber 44*a* are provided with the damper films 45*b* and 45*a*, respectively, and the damper films 45*b* and 45*a* serve as walls defining the upper surface of the ink containing chamber 44*b* and the lower surface of the ink containing chamber 44*a*. A partition wall 49 is disposed between the ink containing chamber 44*b* and the ink containing chamber 44*a*, and the ink containing chamber 44*b* and the ink containing chamber 44*a* are partitioned by the partition wall 49.

The upper surface of the ink containing chamber 44*d* and the lower surface of the ink containing chamber 44*c* are provided with the damper films 45*d* and 45*c*, respectively, and the damper films 45*d* and 45*c* serve as walls defining the upper surface of the ink containing chamber 44*d* and the lower surface of the ink containing chamber 44*c*. A partition wall 50 is disposed between the ink containing chamber 44*d* and the ink containing chamber 44*c*, and the ink containing chamber 44*d* and the ink containing chamber 44*c* are partitioned by the partition wall 50. A space is formed between the ink containing chamber 44*a* and the ink containing chamber 44*d*.

Here, when the sub-tank 4 reciprocates in the scanning direction along with the carriage 2 at the time of performing a printing operation and the like, the ink in the sub-tank 4 vibrates to cause a variation in pressure of the sub-tank 4. However, since the damper films 45*a* to 45*d* are deformed, the variation in pressure of the ink is suppressed.

The ink flow channel 43*a* extends to the same height as the ink containing chamber 44*a* from the front end (upper end in FIG. 4) of the ink flow channel 42*a* to the just downside (downside in FIG. 5A), is bent to the left of FIG. 5A at the position, and is then connected to the ink containing chamber 44*a*.

The ink flow channel 43*b* extends from the front end (upper end in FIG. 4) of the ink flow channel 42*b* in the extending direction (to the left side of FIG. 5B) of the ink flow channel 42*b* and is then connected to the ink containing chamber 44*b*.

The ink flow channel 43*c* extends to the same height as the ink containing chamber 44*c* from the front end (upper end in FIG. 4) of the ink flow channel 42*c* to the just downside (downside in FIG. 5C), is bent to the left of FIG. 5C at the position, and is then connected to the ink containing chamber 44*c*.

The ink flow channel 43*d* extends to the same height as the ink containing chamber 44*d* from the front end (upper end in FIG. 4) of the ink flow channel 42*d* to the just downside (downside in FIG. 5D), is bent to the left of FIG. 5D at the position, and is then connected to the ink containing chamber 44*d*.

The ink flow channels 46*a* to 46*d* extend from the left ends of the ink containing chambers 44*a* to 44*d* in FIGS. 5A to 5D to the left side in the drawings and are connected to the ink flow channels 47*a* to 47*d*. The ink flow channels 47*a* to 47*d* extends in the vertical direction and are arranged from the left of FIG. 4 in the horizontal direction of FIG. 4 in the order of the ink flow channels 47*a*, 47*b*, 47*c*, and 47*d*.

The lower ends of the ink flow channels 47*a* to 47*d* are ink supply ports 48*a* to 48*d* of which the lower ends are opened, and the ink supply ports 48*a* to 48*d* are connected to the ink supply holes 89 (see FIG. 6) formed in the top surface of the ink-jet head 3. The ink in the ink flow channels 47*a* to 47*d* are supplied from the ink supply ports 48*a* to 48*d* to the ink-jet head 3.

The upper ends of the ink flow channels 47*a* to 47*d* are opened and a gas permeable film 60 disposed to cover the openings is disposed at positions overlapping with the ink flow channels 47*a* to 47*d* as viewed from the top side of the sub-tank body 22. The gas permeable film 60 passes only gas and thus the ink in the ink flow channels 47*a* to 47*d* cannot pass through the gas permeable film 60. Accordingly, as described later, when the gas in the discharge channel is suctioned by the suction pump 14, or when the pressure of the discharge channel is maintained in a negative pressure lower than the atmospheric pressure, only the gas in the ink flow channels 47*a* to 47*d* is suctioned due to the negative pressure of the discharge channel and is discharged to the discharge channel.

In the printer 1, the ink in the ink cartridges 6*a* to 6*d* flow into the inflow tubes 31*a* to 31*d* from the tubes 5*a* to 5*d* and flows into the ink containing chambers 44*a* to 44*d* through the connection holes 41*a* to 41*d* and the ink flow channels 42*a* to 42*d* and 43*a* to 43*d*. The ink temporarily contained in the ink containing chambers 44*a* to 44*d* flows into the ink flow channels 47*a* to 47*d* from the ink flow channels 46*a* to 46*d* and is then supplied to the ink-jet head 3 through the ink supply ports 48*a* to 48*d*. That is, the flow channels extending from the ink cartridges 6*a* to 6*d* to the ink-jet head 3 through the tubes 5*a* to 5*d*, the inflow tubes 31*a* to 31*d*, the connection holes 41*a* to 41*d*, the ink flow channels 42*a* to 42*d* and 43*a* to 43*d*, the ink containing chambers 44*a* to 44*d*, and the ink flow channels 46*a* to 46*d* and 47*a* to 47*d* serve as the ink supply channel (liquid supply channel) supplying the ink to the ink-jet head 3.

The discharge unit 23 forms a discharge channel discharging the gas in the sub-tank body 22 to the outside, and includes a connecting portion 61 and a discharge tube 62. The connecting portion 61 is a portion connected to the sub-tank body 22, and is disposed at positions overlapping with the ink flow channels 47*a* to 47*d* as viewed from the top side of the sub-tank body 22 so as to cover the ink flow channels 47*a* to 47*d* over the ink flow channels 47*a* to 47*d*. Individual gas chambers 63*a* to 63*d*, communication channels 64*a* to 64*d*, and a common gas chamber 65 are formed in the connection portion 61.

The individual gas chambers 63*a* to 63*d* are disposed at positions overlapping with the ink flow channels 47*a* to 47*d* in the plan view, and the ink flow channels 47*a* to 47*d* and the individual gas chambers 63*a* to 63*d* communicate with each other through the gas permeable film 60, respectively. That is, the gas permeable film 60 forms a wall partitioning the ink flow channels 47*a* to 47*d* and the individual gas chambers 63*a* to 63*d*, in the connecting portions between the ink flow channels 47*a* to 47*d* (ink supply channel) and the individual gas chambers 63*a* to 63*d* (discharge channel). The common gas chamber 65 is disposed above the individual gas chambers 63*a* to 63*d* so as to substantially cover the lower halves of the individual gas chambers 63*a* to 63*d* in FIG. 4. The communication channels 64*a* to 64*d* are disposed between the individual gas chambers 63*a* to 63*d* and the common gas chamber 65, and extend vertically to allow the individual gas chambers 63*a* to 63*d* to communicate with the common gas chamber 65.

The discharge tube 62 is a cylindrical tube, one end of which is connected to the substantially center portion of the lower side surface of the common gas chamber 65 in FIG. 4, extends to the downside of FIG. 4, and is bent to the left side of FIG. 4 in the middle way. The inflow tubes 21*a* to 21*d* and the discharge tube 62 are arranged in the scanning direction with a constant interval. The end of the discharge tube 62 extending to the left side of FIG. 4 is connected to the tube 7*a* (the tube 7*a* is not shown in FIGS. 3 and 4).

Figure 6:
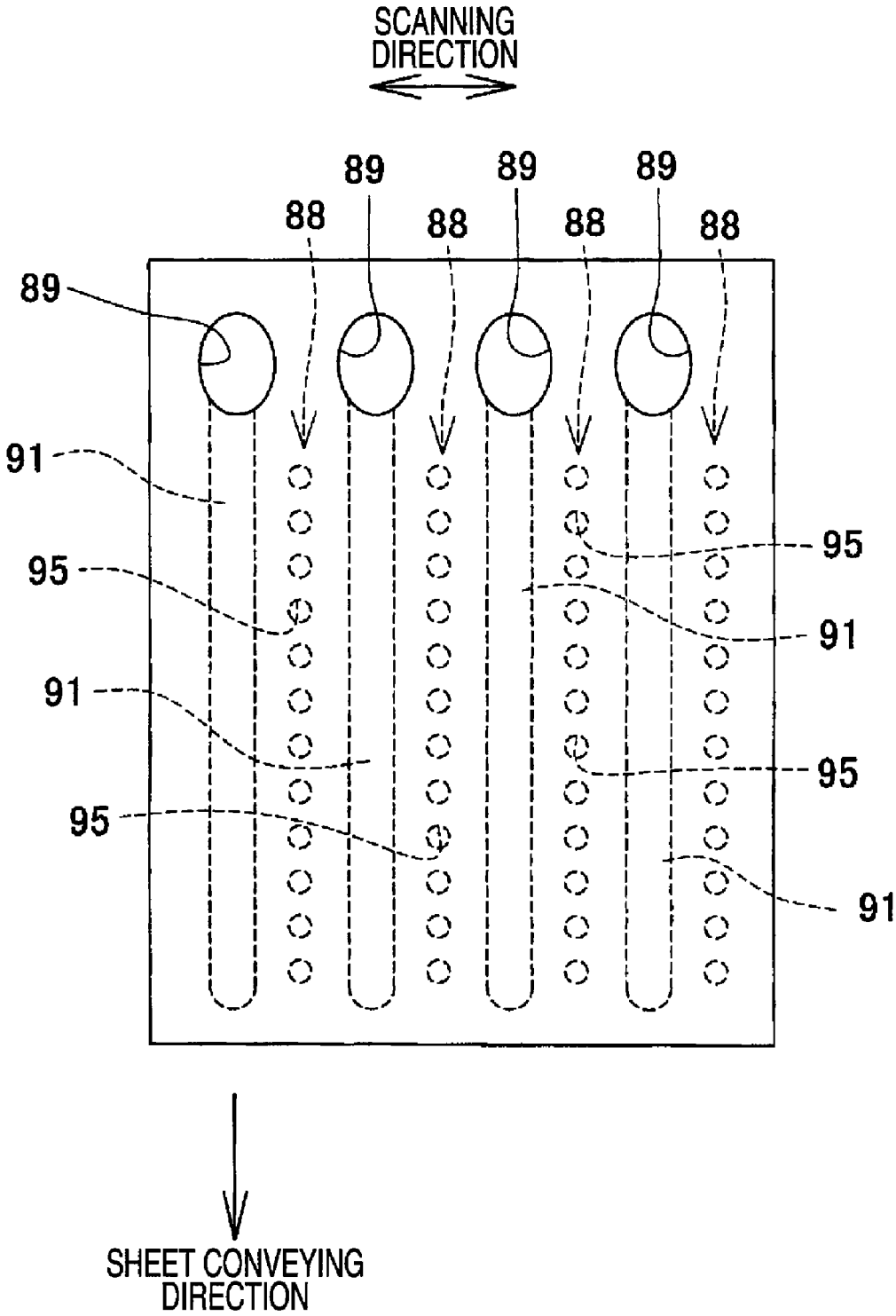
FIG. 6 is a plan view illustrating an ink-jet head shown in FIG. 1.
Figure 7:
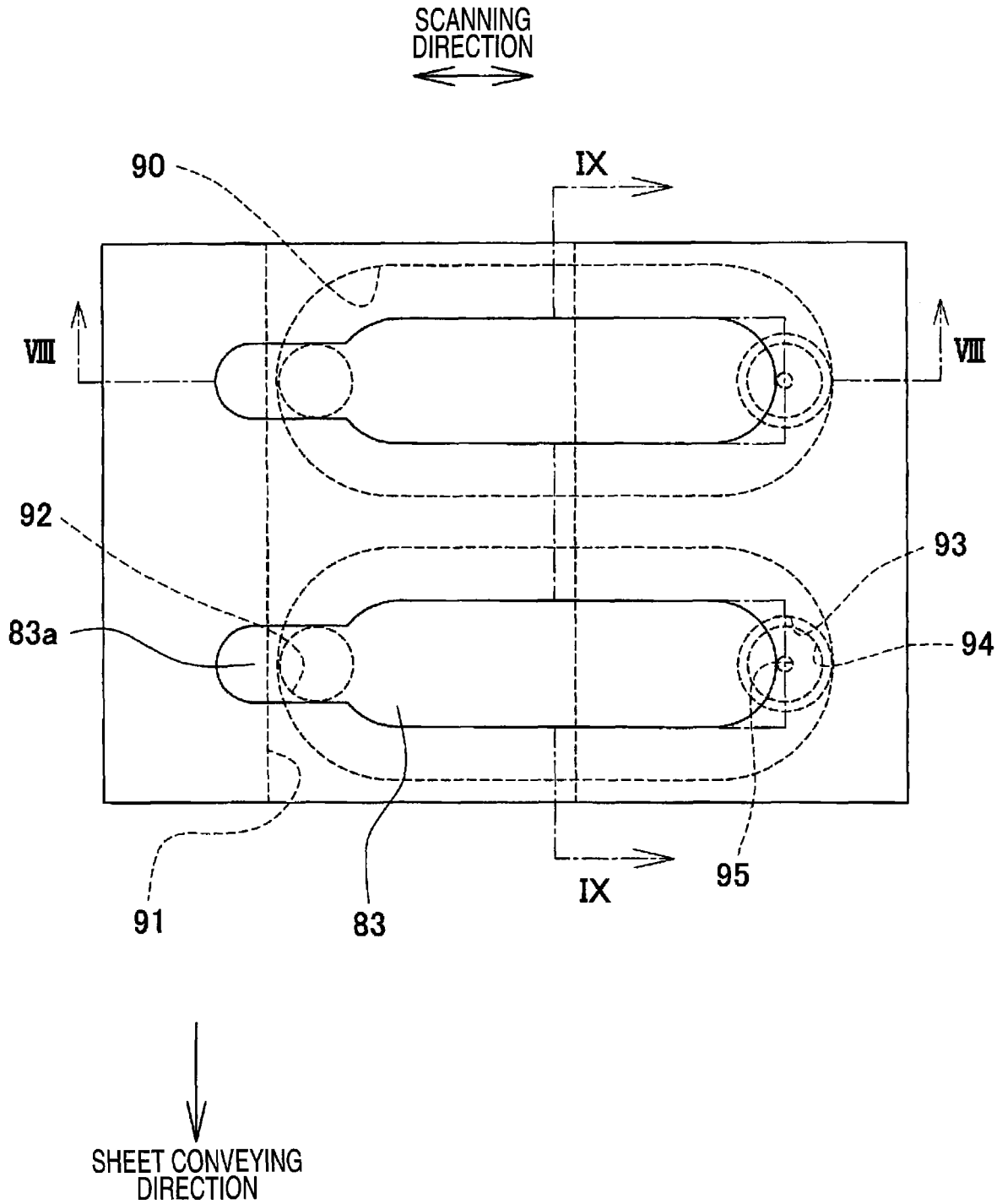
FIG. 7 is a partially enlarged view of FIG. 6.
Figure 8:
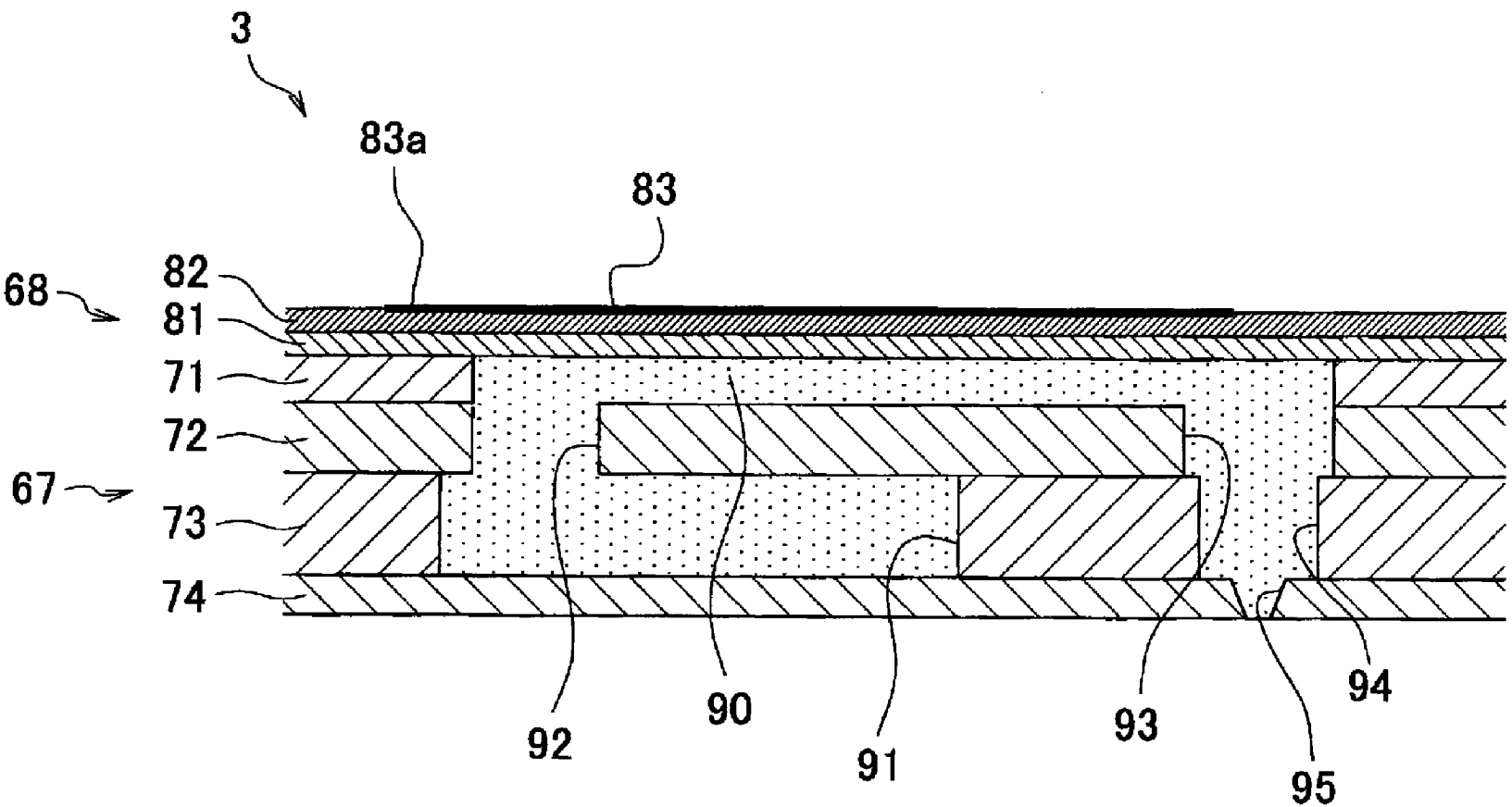
FIG. 8 is a sectional view taken along line VIII-VIII of FIG. 7.
Figure 9:
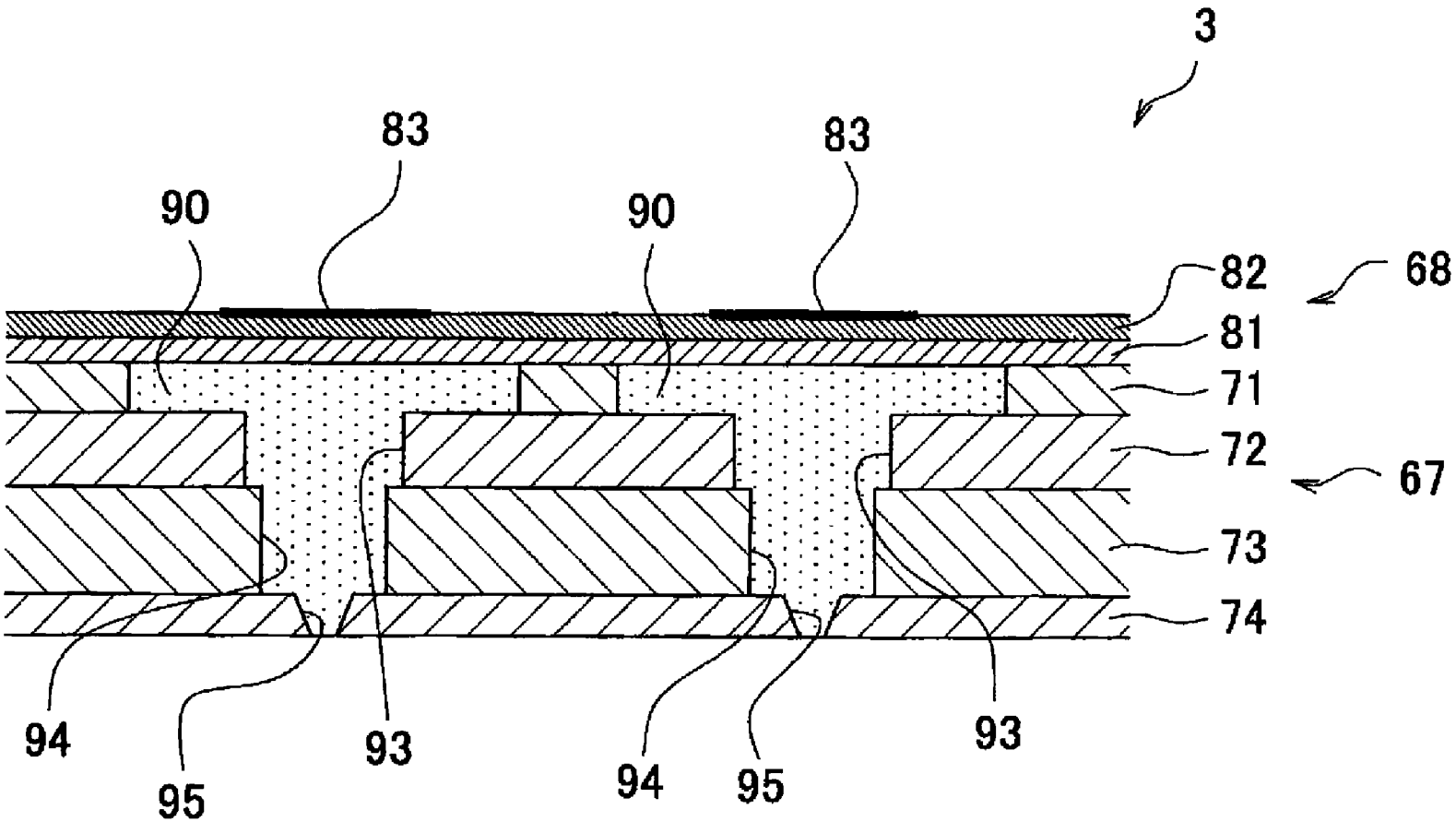
FIG. 9 is a sectional view taken along line IX-IX of FIG. 7.

The ink-jet head 3 will be described now. FIG. 6 is a plan view of the ink-jet head 3 shown in FIG. 1. FIG. 7 is a partially enlarged view of FIG. 6. FIG. 8 is a sectional view taken along line VIII-VIII of FIG. 7. FIG. 9 is a sectional view taken along line IX-IX of FIG. 7. Here, for the purpose of easily understanding the drawings, in FIG. 6, a pressure chamber 90 and through holes 92 to 94 described later are not shown and the nozzles 95 are shown greater than those of FIGS. 7 to 9.

As shown in FIGS. 6 to 9, the ink-jet head 3 includes a flow channel unit 67 having an ink flow channel such as the pressure chamber 90 formed therein and a piezoelectric actuator 68 disposed on the top surface of the flow channel unit 67.

The flow channel unit 67 is formed by stacking four plates of a cavity plate 71, a base plate 72, a manifold plate 73, and a nozzle plate 74 sequentially from the top side. Among the four plates 71 to 74, three plates 71 to 73 other than the nozzle plate 74 are made of a metal material such as stainless and the nozzle plate 74 is made of a synthetic resin material such as polyimide. Alternatively, the nozzle plate 74 may be made of the metal material, similarly to the three plates 71 to 73.

Plural nozzles 95 are formed in the nozzle plate 74. The plural nozzles 95 are arranged in the sheet conveying direction (vertical direction in FIG. 6) to form nozzle rows 88. Four nozzle rows 88 are arranged in the scanning direction (horizontal direction in FIG. 6). The four nozzle rows 88 including the nozzles 95 for ejecting black, yellow, cyan, and magenta are arranged sequentially from the left nozzle row 88 in FIG. 6.

Plural pressure chambers 90 are formed in the cavity plate 71 to correspond to the plural nozzles 95. The pressure chambers 90 have a substantially elliptical planar shape having the scanning direction as its longitudinal direction and the right end of each pressure chamber 90 overlaps with the corresponding nozzle 95 in the plan view. The base plate 72 has through holes 92 and 93 formed at positions overlapping with both ends in the longitudinal direction of the pressure chamber 90 in the plan view.

Four manifold flow channels 91 extending in the sheet conveying direction are formed on the left side of the nozzle rows 88 in the manifold plate 73 to correspond to the four nozzle rows 88. Each manifold flow channel 91 overlaps with substantially the left half of the corresponding pressure chamber 90 in the plan view. The upper ends of the manifold flow channels 91 in FIG. 6 are provided with ink supply holes 89, respectively. The ink supply holes 89 are connected to the ink supply ports 48*a* to 48*d* of the sub-tank 4 as described above, and the ink in the sub-tank 4 is supplied to the manifold flow channels 91 through the ink supply holes 89. The manifold plate 73 has through holes 94 formed at positions overlapping with the through holes 93 and the nozzles 95 in the plan view.

In the flow channel unit 67, the manifold flow channel 91 communicates with the pressure chamber 90 through the through hole 92 and the pressure chamber 90 communicates with the nozzle 95 through the through holes 93 and 94. In this way, plural individual ink flow channels extending from the exits of the manifold flow channels 91 to the nozzles 95 through the pressure chambers 90 are formed in the flow-channel unit 67.

The piezoelectric actuator 68 includes a vibrating plate 81, a piezoelectric layer 82, and plural individual electrodes 83. The vibrating plate 81 is made of a conductive material such as a metal material and is bonded to the top surface of the cavity plate 71 to cover the plural pressure chambers 90. The vibrating plate 81 having conductivity serves as a common electrode for applying an electric field to a portion of the piezoelectric layer 82 between the individual electrodes 83 as described later, is connected to a driver IC not shown, and is always maintained in a ground potential.

The piezoelectric layer 82 has mixed crystals of lead titanate and lead zirconate, is made of a piezoelectric material containing lead zirconate titanate as a main component and having a ferroelectric property, and is disposed continuously on the top surface of the vibrating plate 81 to cover the plural pressure chambers 90. The piezoelectric layer 82 is polarized in advance in its thickness direction.

The plural individual electrodes 83 are disposed on the top surface of the piezoelectric layer 82 to correspond to the plural pressure chambers 90. The individual electrodes 83 have a substantially elliptical planar shape slightly smaller than the pressure chambers 90 and are disposed at positions overlapping with the center portions of the pressure chambers 90 in the plan view. An end (left end in FIG. 7) in the longitudinal direction of each individual electrode 83 extends to the left side up to the position not overlapping with the pressure chamber 90 in the plan view and the front end serves as a contact point 83*a*. The contact point 83*a* is connected to a driver IC not shown through a wiring member such as a flexible printed circuit board (FPC, not shown). A driving voltage is selectively applied to the individual electrodes 83 by the driver IC.

Here, a method of driving the piezoelectric actuator 68 will be described.

In the piezoelectric actuator 68, the potentials of the individual electrodes 83 are maintained in a ground potential in advance by the driver IC not shown. When the driving voltage is applied to one of the plural individual electrodes 83 by the driver IC, a potential difference is generated between the individual electrode 83 to which the driving voltage is applied and the vibrating plate 81 as the common electrode maintained in the ground potential and thus an electric field in the thickness direction is generated in the portion of the piezoelectric layer 80 interposed between the individual electrode 83 and the vibrating plate 81. Since the direction of the electric field is parallel to the polarization direction of the piezoelectric layer 82, the portion of the piezoelectric layer 82 contracts in the horizontal direction perpendicular to the polarization direction. Accordingly, portions of the vibrating plate 81 and the piezoelectric layer 82 opposed to the pressure chamber 90 corresponding to the individual electrode 83 to which the driving voltage is applied are deformed to be convex toward the pressure chamber 90 as a whole and the volume of the pressure chamber 90 decreases. Accordingly, the pressure of the ink in the pressure chamber 90 increases and the ink is ejected from the nozzle 95 communicating with the pressure chamber 90.

Figure 10:
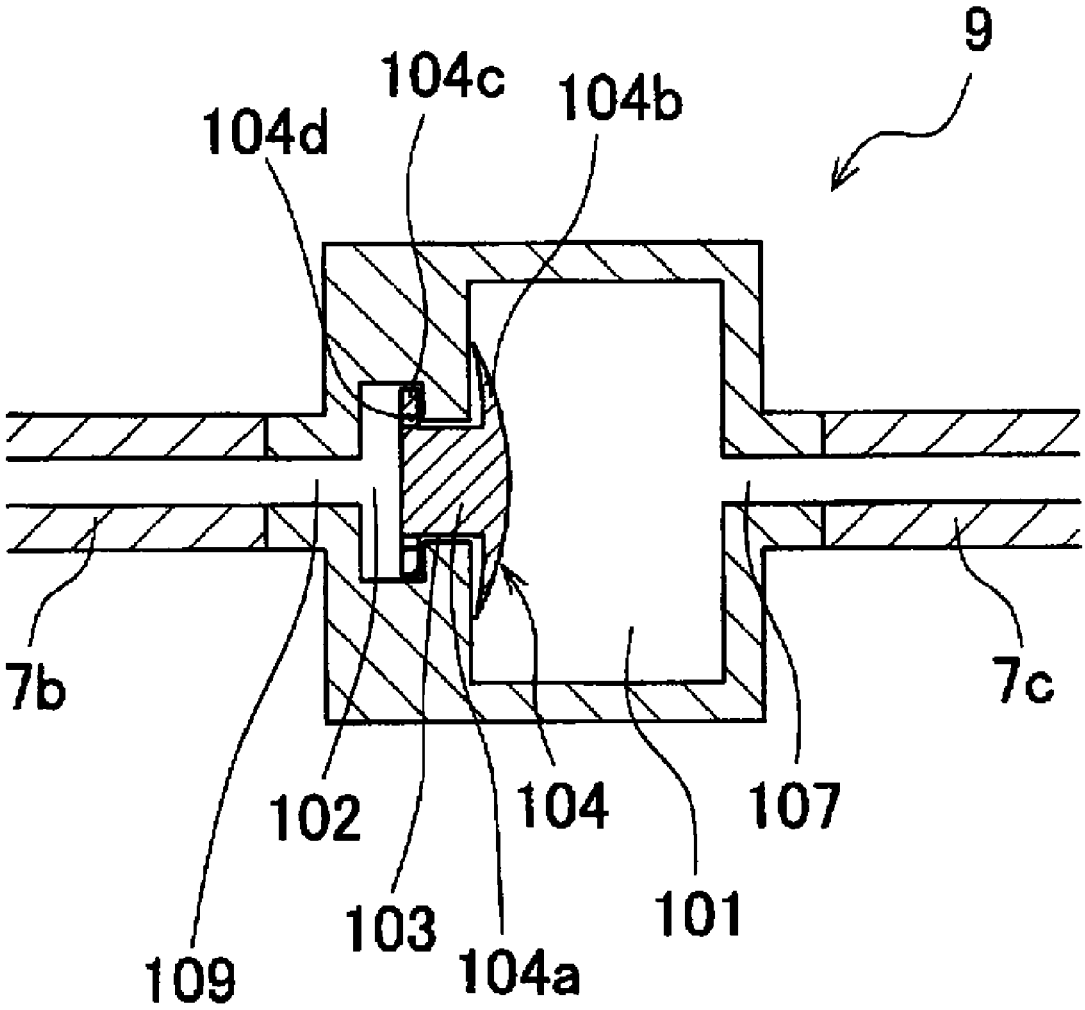
FIG. 10 is a sectional view illustrating a configuration of a differential pressure regulating valve shown in FIG. 1.

The differential pressure regulating valve 9 will be described now. FIG. 10 is a sectional view illustrating a configuration of the differential pressure regulating valve 9 shown in FIG. 1.

As shown in FIG. 10, the differential pressure regulating valve 9 includes gas chambers 101 and 102 and a communication channel 103 forming the discharge channel and a valve body 104 disposed in the gas chambers 101 and 102 and the communication channel 103. The gas chamber 101 and the gas chamber 102 are arranged in the horizontal direction of FIG. 10. The gas chamber 101 communicates with the tube 7*c* at a communication hole 107 disposed at the right end in FIG. 10 and the gas chamber 102 communicates with the tube 7*b* at a communication hole 109 disposed at the left end in FIG. 10. The communication channel 103 is a flow channel having a substantially circular shape as viewed in the horizontal direction of FIG. 10, extending in the horizontal direction between the gas chamber 101 and the gas chamber 102, and allowing the gas chamber 101 and the gas chamber 102 to communicate with each other and the diameter thereof is smaller than the length of the gas chambers 101 and 102 in the vertical direction and the direction perpendicular to the paper surface of FIG. 10.

The valve body 104 includes a cylindrical portion 104*a*, a blocking portion 104*b*, and a drop-preventing portion 104*c*. The cylindrical portion 104*a* has a substantially cylindrical shape having a diameter slightly smaller than that of the communication channel 103 and extends from the left end of the gas chamber 101 in FIG. 10 to the right end of the gas chamber 102 in FIG. 10 through the communication channel 103. The blocking portion 104*b* is disposed at the right end of the cylindrical portion 104*a* in FIG. 10 and extends from the cylindrical portion 104*a* to the outside in a mountain shape, and its diameter is greater than the communication channel 103. The drop-preventing portion 104*c* is disposed at the left end of the cylindrical portion 104*a* in FIG. 10 and extends from the cylindrical portion 104*a* to the outside, and its diameter is greater than that of the communication channel 103. Plural through holes 104*d* are formed in the drop-preventing portion 104*c* at positions overlapping with the edge of the communication channel 103 in the horizontal direction in FIG. 10.

When the gas in the discharge channel is suctioned by the suction pump 14, the valve body 104 moves to the right in FIG. 10 due to the suction force of the suction pump 14. Accordingly, a gap is generated between the blocking portion 104*b* and the left wall of the gas chamber 101 in FIG. 10 (the valve is opened). As a result, the gas chamber 101 and the gas chamber 102 communicate with each other through the through hole 104*d* and the communication channel 103. Accordingly, the discharge channel communicates with the switching unit 15 (suction pump 14). At this time, since the right surface of the drop-preventing portion 104*c* comes in contact with the right wall of the gas chamber 102, the valve body 104 is prevented from dropping from the communication channel 103. By suctioning the gas in the discharge channel by the use of the suction pump 14, the pressure of the discharge channel decreases into a negative pressure lower than the atmospheric pressure.

On the other hand, the pressure of the gas chamber 102 is a negative pressure. Accordingly, when the suction pump 14 is stopped after the gas in the discharge channel is suctioned by the suction pump 14, the valve body 104 is suctioned due to the negative pressure to move to the left in FIG. 10 and the outer edge of the blocking portion 104*b* is pressed against the left wall of the gas chamber 101 in FIG. 10. As a result, the gap between the blocking portion 104*b* and the left wall of the gas chamber 101 disappears and the communication between the gas chamber 101 and the gas chamber 102 through the communication channel 103 is blocked. At this time, the portion of the discharge channel between the differential pressure regulating valve 9 and the gas permeable film 60 does not communicate with the outside and is thus closed.

Accordingly, the gas does not flow in the portion of the discharge channel between the differential pressure regulating valve 9 and the gas permeable film 60 and thus the negative pressure is maintained. As a result, even after the gas in the discharge channel is suctioned by the suction pump 14, the gas in the ink flow channels 47*a* to 47*d* is suctioned due to the negative pressure and is discharge to the discharge channel.

In this way, when the pressure of the space in the discharge channel closer to the sub-tank 4 than the valve body 104 is sufficiently smaller than the pressure of the space in the discharge channel closer to the switching unit 15 (the suction pump 14) than the valve body 104 (when the pressure of the space in the discharge channel close to the sub-tank 4 is smaller and the difference in pressure between two spaces is greater than a predetermined value), the differential pressure regulating valve 9 according to this exemplary embodiment blocks the communication between two spaces. Otherwise (when the difference in pressure between two spaces is smaller than the predetermined value or when the pressures of two spaces are equal to each other or the pressure of the space in the discharge channel close to the switching unit 15 is smaller, the differential pressure regulating valve permits the communication between two spaces. The differential pressure regulating valve 9 according to this exemplary embodiment is also a one-way valve permitting a flow of gas from the sub-tank 4 to the switching unit 15 and blocking a flow of gas from the switching unit 15 to the sub-tank 4.

The differential pressure regulating valve 9 is opened by the suction force of the suction pump 14 to allow the discharge channel and the suction pump 14 to communicate with each other and blocks the communicate between the discharge channel and the suction pump 14 at the time of stopping the suction of the gas in the discharge channel by the suction pump 14. Accordingly, a particular unit for switching the differential pressure regulating valve 9 is not required, thereby simplifying the configuration of the printer 1.

Figure 11A:
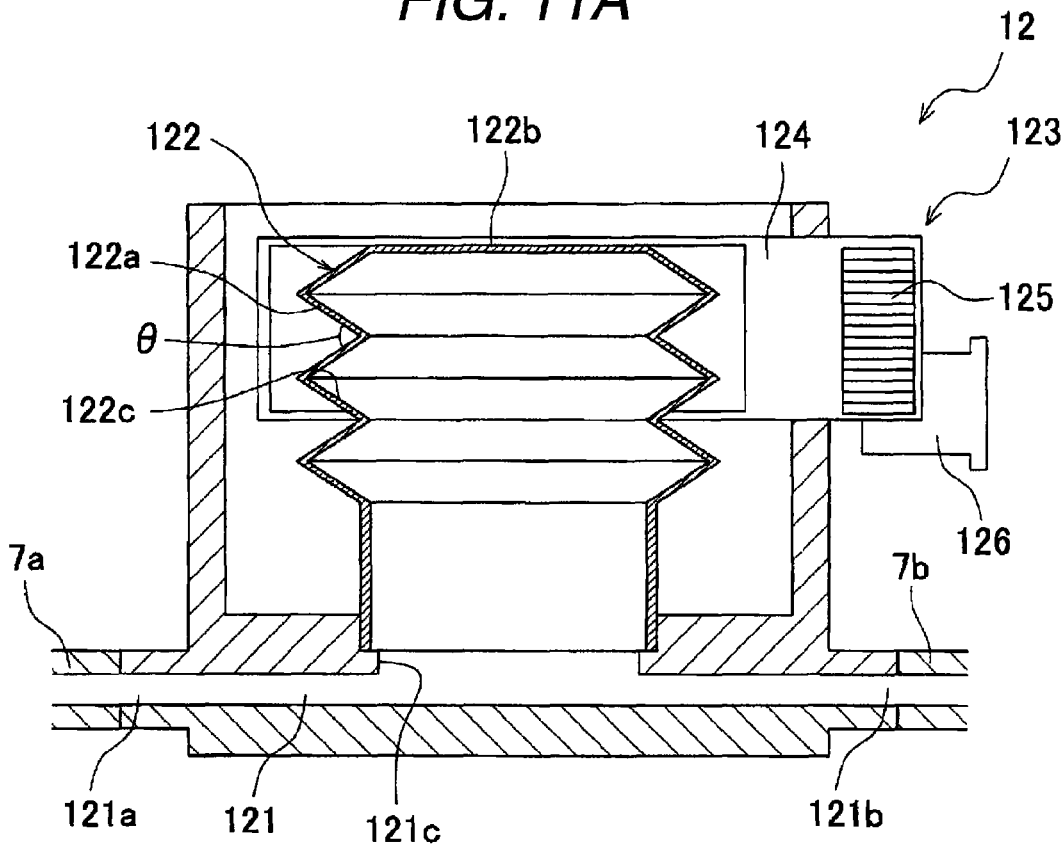
FIGS. 11A and 11B are diagrams illustrating a charge tank shown in FIG. 1.
Figure 11B:
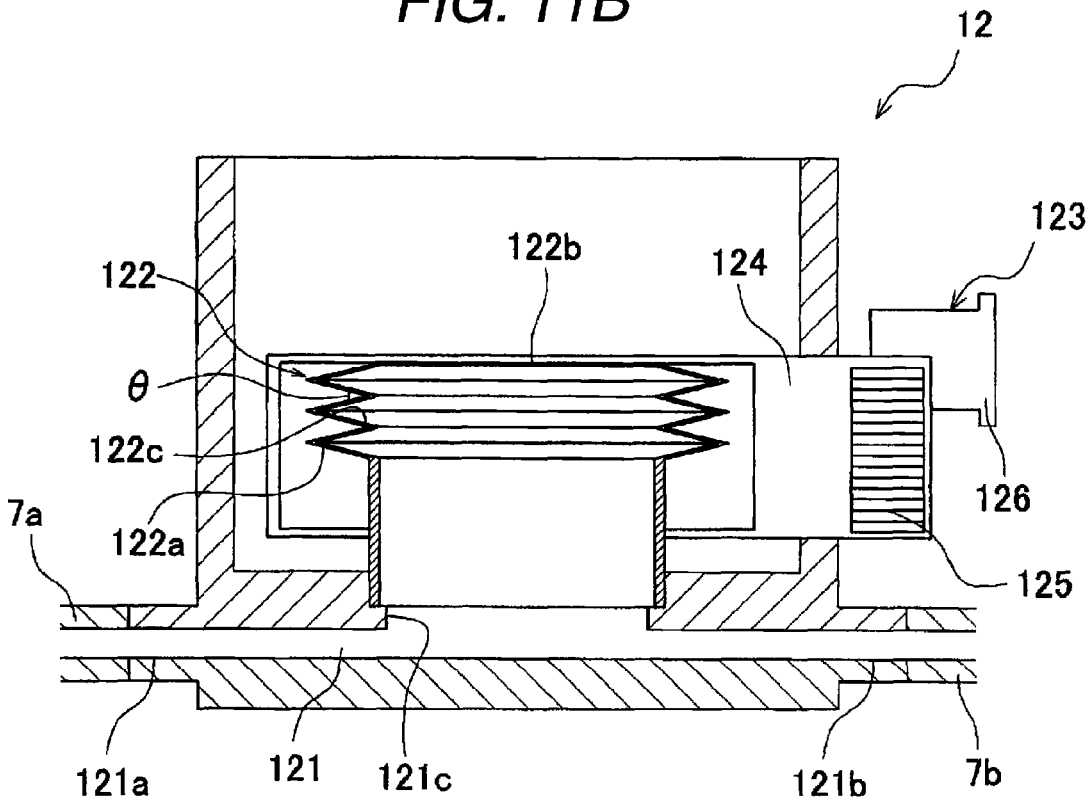

The charge tank 12 is described now. FIGS. 11A and 11B are sectional views illustrating a configuration of the charge tank 12, where FIG. 11A shows a state where the pressure of a charge chamber 122*c* (described later) is the atmospheric pressure and FIG. 11B shows a state where the pressure of the charge chamber 122*c* is a negative pressure. As shown in FIGS. 11A and 11B, the charge tank 12 includes a gas flow channel 121 forming the discharge channel, a bellows portion 122, and a volume detecting sensor 123.

The gas flow channel 121 extends in the horizontal direction in FIG. 11A or 11B and communicates with the tubes 7*a* and 7*b* at communication holes 121*a* and 121*b* disposed on both ends in the drawing. A communication hole 121*c* allowing the gas flow channel 121 to communicate with a below-described charge chamber 122*c* of the bellows portion 122 is disposed in the top surface of the substantial center portion of the gas flow channel 121 in FIG. 11A or 11B.

The bellows portion 122 extends in the vertical direction in FIG. 11A or 11B and has a charge chamber 122*c* (volume varying chamber) surrounded with a top wall 122*b* and a side wall 122*a*. The top wall 122*b* is a wall defining the upper end of the charge chamber 122*c* and has a substantially circular planar shape. The side wall 122*a* is a wall defining the side surface of the charge chamber 122*c* and extends downward from the outer edges of the top wall 122*b* while being alternately bent to the outside and the inside of the charge chamber 122*c*. Accordingly, by applying a vertical force to the top wall 122*b*, the top wall 122*b* moves in the vertical direction and the bending angle θ of the side wall 122*a* varies, whereby the volume of the charge chamber 122*c* varies. The lower end of the charge chamber 122*c* is opened and is connected to the communication hole 121*c*. Accordingly, the gas flow channel 121 communicates with the charge chamber 122*c*.

When the pressure of the charge chamber 122*c* is the atmospheric pressure, as shown in FIG. 11A, the top wall 122*b* of the bellows portion 122 is located at the highest position and the bending angle θ of the side wall 122*a* is the largest. When the pressure of the charge chamber 122*c* decreases by suctioning the gas from the tube 7*c* by the use of the suction pump 14, a downward force acts on the top wall 122*b* due to the difference between the external atmospheric pressure and the negative pressure of the charge chamber 122*c*. Accordingly, as shown in FIG. 11B, the top wall 122*b* moves down and the bending angle θ of the side wall 122*a* decreases with the movement. With the deformation of the bellows portion 122, the volume of the charge chamber 122*c* decreases.

Here, when the bending angle θ of the side wall 122*a* decreases, an upward restoring force in FIG. 11A or 11B for restoring the top wall to the state shown in FIG. 11A acts on the side wall 122*a* and the restoring force increases as the bending angle θ of the side wall 122*a* decreases. Accordingly, in the bellows portion 122, the variation in volume of the charge chamber 122*c* is stopped when the force resulting from the difference between the atmospheric pressure and the pressure of the charge chamber 122*c* is balanced with the restoring force. As a result, as the pressure of the charge chamber 122*c* becomes lower, the volume of the charge chamber 122*c* becomes smaller. That is, the pressure of the charge chamber 122*c* and the volume of the charge chamber 122*c* have a predetermined relation.

On the contrary, as shown in FIG. 11B, when the charge chamber 122*c* is maintained in the negative pressure and the gas in the ink flow channels 47*a* to 47*d* (the ink supply channel) is discharged to the individual gas chambers 63*a* to 63*d* (the discharge channel) through the gas permeable film 60, the pressure of the charge chamber 122*c* communicating with the discharge channel increases as much as the discharged gas. Accordingly, the downward force generated due to the difference between the atmospheric pressure and the pressure of the charge chamber 122*c* decreases, the top wall 122*b* of the bellows portion 122 moves up, and the bending angle θ of the side wall 122*a* increases with the movement. With the deformation of the bellows portion 122, the volume of the charge chamber 122*c* increases.

Here, since the charge chamber 122*c* is disposed in the discharge channel, the total volume of the discharge channel and the charge chamber 122*c* increases as much as the volume of the charge chamber 122*c*, compared with the volume of the discharge channel not having the charge tank 12. Accordingly, the increase in pressure of the discharge channel can be slowed when the gas flows into the discharge channel from the ink supply channel, thereby elongating the time when the discharge channel is maintained in the negative pressure. Even when the gas flows into the discharge channel from the ink supply channel and the volume of the charge chamber 122*c* increases, the variation in volume of the charge chamber 122*c* is stopped by means of the balance between the force resulting from the difference between the atmospheric pressure and the pressure of the charge chamber 122*c* and the restoring force due to the side wall 122*a* of the bellows portion 122, similarly to the case where the gas in the discharge channel is suctioned by the suction pump 14. That is, in this case, the pressure of the charge chamber 122*c* and the volume of the charge chamber 122*c* have a predetermined relation.

The volume detecting sensor 123 is a sensor for detecting the volume of the charge chamber 122*c* and includes a movable portion 124, plural slits 125, and a slit detecting sensor 126. The movable portion 124 moves up and down along with the top wall 122*b* of the bellows portion 122. The plural slits 125 are disposed at the right end of the movable portion 124 in FIG. 11A or 11B, extend in the horizontal direction in the drawing, and are arranged in the vertical direction. The slit detecting sensor 126 detects that the slits 125 vertically pass through the slit detecting sensor 126. Since the plural slits 125 move up and down along with the top wall 122*b*, it is possible to detect the volume of the charge chamber 122*c* in plural stages by detecting that the slits 125 pass through the slit detecting sensor 126 by the use of the slit detecting sensor 126.

As described above, the position of the top wall 122*b*, that is, the volume of the charge chamber 122*c*, and the pressure of the charge chamber 122*c* have a predetermined relation. Accordingly, the volume detecting sensor 123 can detect the pressure of the charge chamber 122*c* in plural stages by detecting that the plural slits 125 moving up and down along with the top wall 122*b* pass through the slit detecting sensor 126 by the use of the slit detecting sensor 126.

When the gas is being discharged from the ink supply channel to the discharge channel in the state where the discharge channel is maintained in the negative pressure, the pressure of the discharge channel and the charge chamber 122*c* increase continuously. Accordingly, the value of the volume of the charge chamber 122*c* detected by the volume detecting sensor 123 sequentially varies. Accordingly, by detecting that the volume of the charge chamber 122*c* detected by the volume detecting sensor 123 varies, it is possible to easily detect that the gas is discharged from the ink supply channel to the discharge channel.

Figure 12:
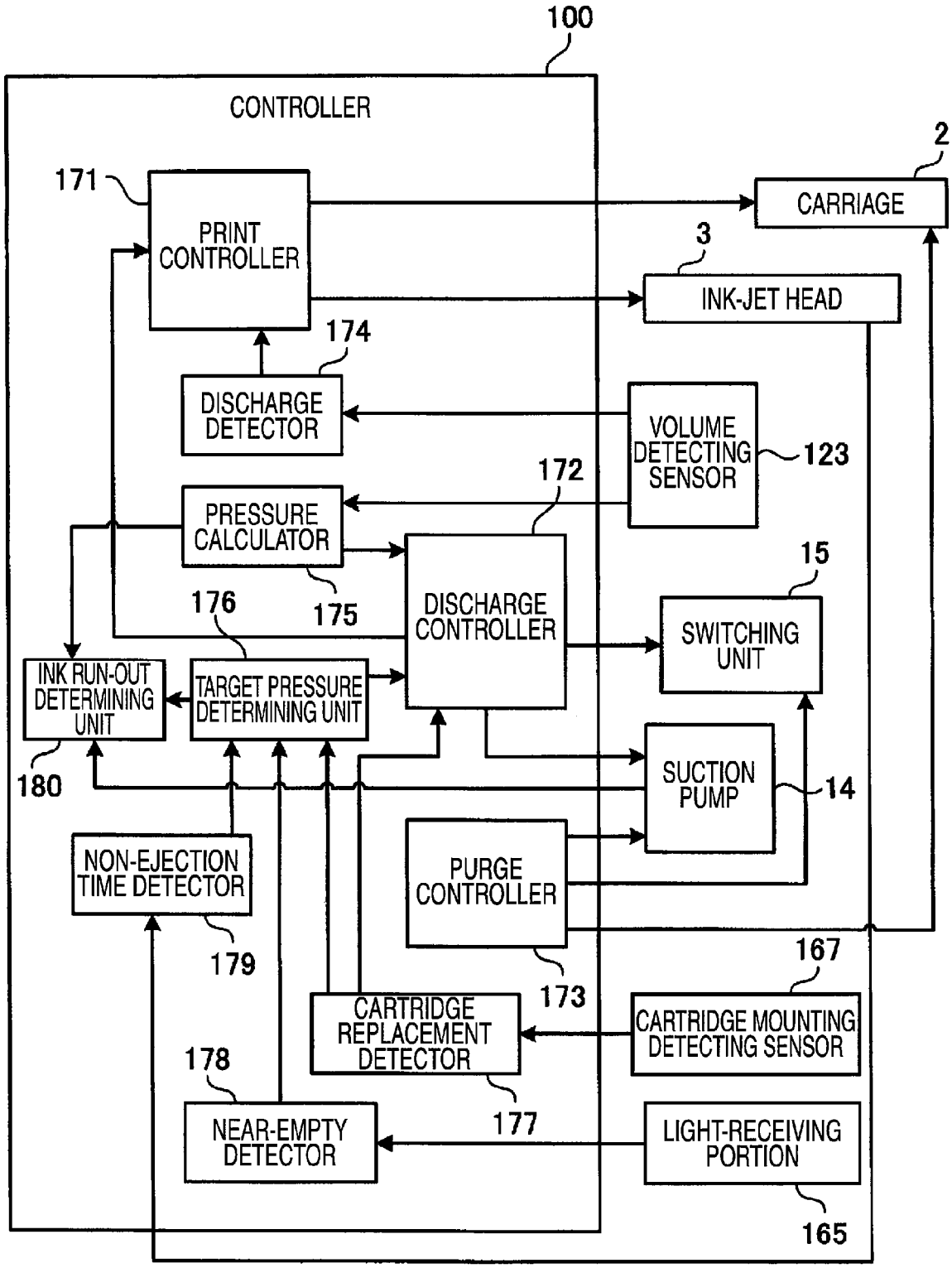
FIG. 12 is a block diagram illustrating a controller shown in FIG. 1.

The controller 100 will be described now. FIG. 12 is a block diagram illustrating the controller 100 shown in FIG. 1. The controller 100 includes a Central Processing Unit (CPU), a Read Only Memory (ROM), and a Random Access Memory (RAM), which serve as a print controller 171, a discharge controller 172, a purge controller 173, a discharge detector 174, a pressure calculator 175, a target pressure determining unit 176, a cartridge replacement detector 177, a near-empty detector 178, a non-ejection time detector 179, and an ink run-out determining unit 180.

The print controller 171 controls operations of the ink-jet head 3 and the carriage 2 at the time of performing a printing operation by the use of the printer 1. As described later, in the state where the discharge channel is maintained in the negative pressure, the print controller 171 stops the printing operation of the ink-jet head 3 while the gas in the ink flow channels 47*a* to 47*d* (ink supply channel) is being discharged to the individual gas chambers 63*a* to 63*d* (discharge channel) due to the negative pressure of the discharge channel and while the gas in the discharge channel is being suctioned by the suction pump 14. More specifically, the print controller stops the application of the driving voltage to the individual electrodes 83 and the movement of the carriage 2.

When the gas in the ink supply channel is being discharged to the discharge channel, the ink in the sub-tank 4 and the ink-jet head 3 communicating with the sub-tank 4 varies in pressure and thus the meniscuses of the nozzles 95 vibrate. Accordingly, when the ink is ejected from the nozzles 95 at that time, the ink ejection characteristic varies such as the leakage of ink from the nozzles 95 not ejecting the ink or the ejection of ink from the nozzles 95 more than necessary, thereby deteriorating the print quality. However, as described later, while the discharge detector 174 is detecting that the gas in the ink supply channel is discharged to the discharge channel and while the gas in the discharge channel is being suctioned by the suction pump 14, the printing operation is stopped. Thus, the ink ejection characteristic does not vary.

The discharge controller 172 controls operations of the suction pump 14 and the switching unit 15 at the time of suctioning the gas in the discharge channel. More specifically, when the pressure of the discharge channel is equal to or greater than a predetermined pressure P1 which is lower than the atmospheric pressure or when one of the ink cartridges 6*a* and 6*d* is replaced, the discharge controller connects the suction pump 14 to the tube 7*c* by the use of the switching unit 15 and actuates the suction pump 14, thereby suctioning the gas in the discharge channel. Until the pressure of the discharge channel reaches a target pressure P2 described later and lower than the predetermined pressure P1, the discharge controller allows the suction pump 14 to continuously suction the gas in the discharge channel. It is noted that the pressure P1 is predetermined and the value thereof is always fixed.

The purge controller 173 controls operations of the suction pump 14, the switching unit 15, and the carriage 2 at the time of suctioning the ink in the ink-jet head 3 from the nozzles 95.

When the discharge channel is closed, the discharge detector 174 detects that the gas in the ink flow channels 47*a* to 47*d* is being discharged to the discharge channel due to the negative pressure of the discharge channel, by detecting that the volume of the charge chamber 122*c* detected by the volume detecting sensor 123 varies.

The pressure calculator 175 calculates the pressure of the discharge channel from the volume of the charge chamber 122*c* detected by the volume detecting sensor 123. Accordingly, it is possible to detect that the pressure of the discharge channel is greater than the predetermined pressure P1 by the use of the pressure calculator 175 and it is possible to detect whether the pressure of the discharge channel reaches the target pressure P2 when the gas in the discharge channel is being suctioned by the suction pump 14. Since a particular high-price pressure sensor need not be provided to detect the pressure of the discharge channel, it is possible to reduce the cost for manufacturing the printer 1.

The target pressure determining unit 176 determines the target pressure P2 which is a target value of the pressure of the discharge channel at the time of suctioning the gas in the discharge channel by the use of the suction pump 14 to reduce the pressure of the discharge channel. Here, the target pressure P2 is a pressure lower than the atmospheric pressure and the predetermined pressure P1, and can be changed by the target pressure determining unit 176 as described later. When the printing operation is not performed in a predetermined time period, when one of the ink cartridges 6*a* to 6*d* is replaced, or when the amount of ink remaining in one ink containing chamber 151 of the ink cartridges 6*a* to 6*d* is smaller than a predetermined amount, the target pressure determining unit 176 determines the target pressure P2 to be lower than a normal target pressure. The target pressure determining unit 176 slowly reduces the normal target pressure P2 with the lapse of time.

Here, when the ink is not ejected from the nozzles 95 for a long time, there is high possibility that a large amount of gas exists in the ink supply channel. However, as described above, by setting the target pressure to be lower than the normal target pressure (the target pressure when the time for not performing the printing operation is smaller than the predetermined time) when the printing operation is not performed in a predetermined time period, the pressure of the discharge channel becomes lower (large negative pressure) than the normal pressure and the gas in the ink supply channel can be efficiently discharged to the discharge channel by the use of the negative pressure, after the gas in the discharge channel is suctioned by the suction pump 14.

When one of the ink cartridges 6*a* to 6*d* is replaced, a large amount of gas flows from the tube 7*a* at the time of replacing the ink cartridge. However, as described above, by setting the target pressure to be lower than the normal pressure (the pressure before replacement of the ink cartridges 6*a* to 6*d*) when one of the ink cartridges 6*a* to 6*d* is replaced, the pressure of the discharge channel becomes lower (large negative pressure) than the normal pressure and the gas in the ink supply channel can be efficiently discharged to the discharge channel by the use of the negative pressure, after the gas in the discharge channel is suctioned by the suction pump 14. In addition, when one of the ink cartridges 6*a* to 6*d* is replaced, the gas flows into the ink supply channel. Accordingly, as described above, by allowing the suction pump 14 to suction the gas in the discharge channel, the pressure of the discharge channel can be made immediately to be the pressure determined by the target pressure determining unit 176.

When the amount of ink remaining in the one ink containing chamber 151 of the ink cartridges 6*a* to 6*d* decreases, the gas in the ink containing chamber 151 can easily flow from the tube 7*a*. However, as described above, by setting the target pressure P2 to be lower than the normal pressure (the pressure when the remaining amount of ink is greater than a predetermined amount) when the amount of ink remaining in the ink containing chamber 151 of the ink cartridges 6*a* to 6*d* is smaller than a predetermined amount, the pressure of the discharge channel becomes lower (large negative pressure) than the normal pressure and the gas in the ink supply channel can be efficiently discharged to the discharge channel by the use of the negative pressure, after the gas in the discharge channel is suctioned by the suction pump 14.

The gas permeable film 60 is deteriorated in gas permeability due to the clogging of ink with the lapse of time. However, by slowly reducing the target pressure P2 with the lapse of time, the pressure of the discharge channel decreases even when the suction pump 14 suctions the gas in the discharge channel, thereby efficiently discharging the gas in the ink flow channels 47*a* to 47*d* to the discharge channel.

The cartridge replacement detector 177 detects that the ink cartridges 6*a* to 6*d* mounted on the cartridge mounting sections 11 are replaced. More specifically, when it is detected by the cartridge mounting detecting sensor 167 that the ink cartridges 6*a* to 6*d* are detached from the cartridge mounting sections 11 and then the ink cartridges 6*a* to 6*d* are mounted on the cartridge mounting section 11, the cartridge replacement detector detects that the ink cartridges 6*a* to 6*d* are replaced.

The near-empty detector 178 detects that the amount of ink remaining in the ink containing chamber 151 is smaller than the predetermined amount. Specifically, in the state where the ink cartridges 6*a* to 6*d* are mounted on the cartridge mounting sections 11, when the light emitted from the light emitting portion 164 is blocked by the light blocking portion 155*b* and the light is not received by the light receiving portion 165, the near-empty detector detects that the amount of ink remaining in the ink containing chamber 151 is smaller than the predetermined amount. The non-ejection time detector 179 detects the time period (non-ejection time) when the ink is not ejected from the nozzles 95 of the ink-jet head 3.

The ink run-out determining unit 180 determines whether the ink in one of the ink cartridges 6*a* to 6*d* mounted on the cartridge mounting sections 11 runs out. More specifically, when the ink in one of the ink cartridges 6*a* to 6*d* runs out, the gas in the ink cartridges 6*a* to 6*d*, in which the ink runs out, flows in the ink supply channel through the tubes 5*a* to 5*d* in spite of the suction of gas in the discharge channel by the use of the suction pump 14 and the gas flows into the individual gas chambers 63*a* to 63*d* through the ink flow channels 47*a* to 47*d*. Accordingly, the pressure of the discharge channel decreases only by a small amount and does not decrease to the target pressure P2. Accordingly, the ink run-out determining unit 180 determines that the ink in one of the ink cartridges 6*a* to 6*d* runs out, when the pressure of the discharge channel calculated by the pressure calculator 175 does not decrease to the target pressure P2 determined by the target pressure determining unit 176 in spite of the suction of gas in the discharge channel by the use of the suction pump 14.

Figure 13:
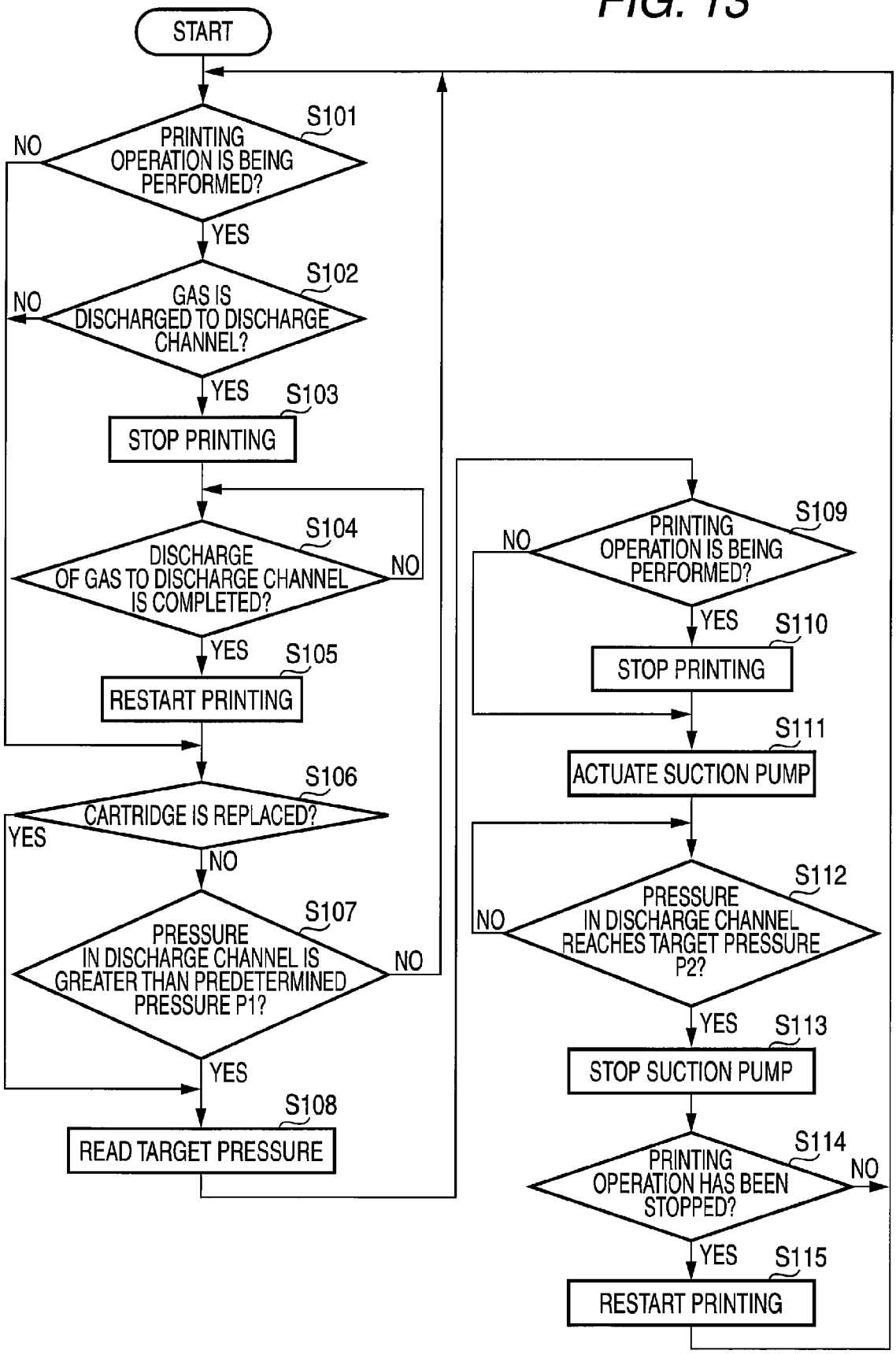
FIG. 13 is a flowchart illustrating a procedure of performing an operation of suctioning gas in a discharge channel by the use of a suction pump, an operation of temporarily stopping a printing operation, and an operation of setting a target pressure.

A procedure of performing an operation of suctioning the gas in the discharge channel by the use of the suction pump 14 of the printer 1, an operation of temporarily stopping the printing operation, and an operation of setting the target pressure P2 will be described now. FIG. 13 is a flowchart illustrating the procedure.

As shown in FIG. 13, in the printer 1, it is determined whether a printing operation is being performed at step S101 (hereinafter simply referred to as S101). When the printing operation is not being performed (No in S101), the process of S106 is performed. When the printing operation is being performed (Yes in S101), it is determined from the detection result of the discharge detector 174 whether the gas in the ink supply channel is being discharged to the discharge channel at S102.

When it is determined that the gas in the ink supply channel is not being discharged to the discharge channel (No in S102), the process of S106 is performed. On the other hand, when it is determined that the gas in the ink supply channel is being discharged to the discharge channel (Yes in S102), the printing operation is stopped at S103 and that state is maintained until the discharge of gas to the discharge channel is completed at S104, that is, until it is not detected by the discharge detector 174 that the gas in the ink supply channel is being discharged to the discharge channel (No in S104).

When the discharge of gas to the discharge channel is completed (Yes in S104), the printing operation is restarted and then the process of S106 is performed.

At S106, it is determined from the detection result of the cartridge replacement detector 177 whether one of the ink cartridges 6*a* to 6*d* is replaced. When it is determined that one of the ink cartridges 6*a* to 6*d* is replaced (Yes in S106), the process of S108 is performed. When it is determined that any of the ink cartridges 6*a* to 6*d* is not replaced (No in S106), it is determined from the calculation result of the pressure calculator 175 whether the pressure of the discharge channel is greater than the predetermined pressure P1 at S107. When it is determined that the pressure of the discharge channel is greater than the predetermined pressure P1 (Yes in S107), the process of S108 is performed. When it is determined that the pressure of the discharge channel is lower than the predetermined pressure P1 (No in S107), the process of S101 is performed again.

In S108, the target pressure P2 determined by the target pressure determining unit 176 is read out. Then, it is determined whether a printing operation is being performed at S109. When the printing operation is performed by the printer 1 (Yes in S109), the printing operation is stopped (S110) and then the suction pump 14 is actuated to suction the gas in the discharge channel (No in S111). On the other hand, when the printing operation is not performed by the printer 1 (No in S109), the suction pump 14 is actuated to suction the gas in the discharge channel at S111. Until the pressure of the discharge channel calculated by the pressure calculator 175 reaches the read target pressure P2, the gas in the discharge channel is continuously suctioned by the suction pump 14 (No in S112). When the pressure of the discharge channel reaches the target pressure P2 (Yes in S112), the operation of the suction pump 14 is stopped at S113.

When the printing operation has been stopped at S110 (Yes in S114), the printing operation is restarted at S115 and then the process of S101 is performed again. Otherwise, the printing operation has not been stopped at S110 (No in S114), the process of S101 is performed again at once without restarting.

According to the above-described exemplary embodiment, in the state where the discharge channel is maintained in a negative pressure, the gas in the ink supply channel is suctioned by the negative pressure of the discharge channel and is discharged to the individual gas chambers 63*a* to 63*d* (discharge channel) when it gets close to the gas permeable films 60 of the ink flow channels 47*a* to 47*d*. Accordingly, it cannot be predictable when the gas in the ink supply channel is discharged to the discharge channel. However, when the gas in the ink supply channel is being discharged to the discharge channel, it is possible to detect that by the use of the discharge detector 174.

When the gas in the ink supply channel is being discharged to the discharge channel, the pressure of the discharge channel varies and thus the volume of the charge chamber 122*c* varying in volume with the variation in pressure of the discharge channel is detected in plural stages by the volume detecting sensor 123. When it is detected that the value detected by the volume detecting sensor 123 varies, it is possible to easily detect that the gas in the ink supply channel is being discharged to the discharge channel by detecting that the pressure of the discharge channel varies by the use of the discharge detector 174.

When the gas in the ink supply channel is being discharged to the discharge channel, the ink in the sub-tank 4 and the ink-jet head 3 varies in pressure. At this time, when the ink is ejected from the nozzles 95, the ink ejection characteristic may vary. However, when the discharge detector 174 is detecting that the gas in the ink supply channel is being discharged to the discharge channel or when the gas in the discharge channel is being suctioned by the suction pump 14, the ejection of ink from the nozzles 95 is stopped. Accordingly, the ink ejection characteristic of the nozzles 95 does not vary at the time of performing the printing operation.

Since the pressure of the charge chamber 122*c* and the pressure of the discharge channel have a predetermined relation, the pressure calculator 175 can easily calculate the pressure of the discharge channel from the volume of the charge chamber 122*c* detected by the volume detecting sensor 123. In addition, when the calculated pressure is greater than the predetermined pressure P1, the gas in the discharge channel can be suctioned by the suction pump 14 to set the pressure of the discharge channel to the target pressure P2 determined by the target pressure determining unit 176. Since a particular high-price pressure sensor need not be provided to detect the pressure of the discharge channel, it is possible to reduce the cost for manufacturing the printer 1.

When there is possibility that a large amount of gas exists in the ink supply channel such as when the ink is not ejected from the nozzles 95 in a predetermined time, when one of the ink cartridges 6*a* to 6*d* is replaced, and when the amount of ink remaining in one ink containing chamber 151 of the ink cartridges 6*a* to 6*d* is smaller than a predetermined amount, the pressure at the time of suctioning the gas in the discharge channel by the use of the suction pump 14 can be reduced by setting the target pressure P2 to be lower than the normal pressure. Accordingly, it is possible to efficiently discharge the gas in the ink supply channel to the discharge channel by the use of the reduce pressure.

When one of the ink cartridges 6*a* to 6*d* is replaced, a large amount of gas flows in through the tube 5*a* at the time of replacing the ink cartridge. Accordingly, by suctioning the gas in the discharge channel by the use of the suction pump 14 at once, it is possible to efficiently discharge the gas in the ink supply channel and to maintain the discharge channel in a pressure lower than the normal pressure.

The gas permeable film 60 is deteriorated in gas permeability due to the clogging of ink with the lapse of time. However, by slowly reducing the target pressure P2 with the lapse of time, it is possible to efficiently discharge the gas in the ink supply channel to the discharge channel.

When the ink in one of the ink cartridges 6*a* to 6*d* runs out, the gas flow into the discharge channel through the ink supply channel from the ink cartridges 6*a* to 6*d* in which the ink runs out. Accordingly, even when the gas in the discharge channel is suctioned by the suction pump 14, the pressure of the discharge channel is hardly reduced. Therefore, when the gas in the discharge channel is suctioned by the suction pump 14 but the pressure of the discharge channel calculated by the pressure calculator 175 does not vary, the ink run-out determining unit 180 can determine that the ink in the ink cartridges 6*a* to 6*d* runs out.

While the present invention has been shown and described with reference to certain exemplary embodiments thereof, it will be understood by those skilled in the art that various changes in form and details may be made therein without departing from the spirit and scope of the invention as defined by the appended claims.

Various modified exemplary embodiments will be described. Here, elements similar to above-described exemplary embodiment are denoted by the same reference numerals and description thereof is properly omitted.

Figure 14A:
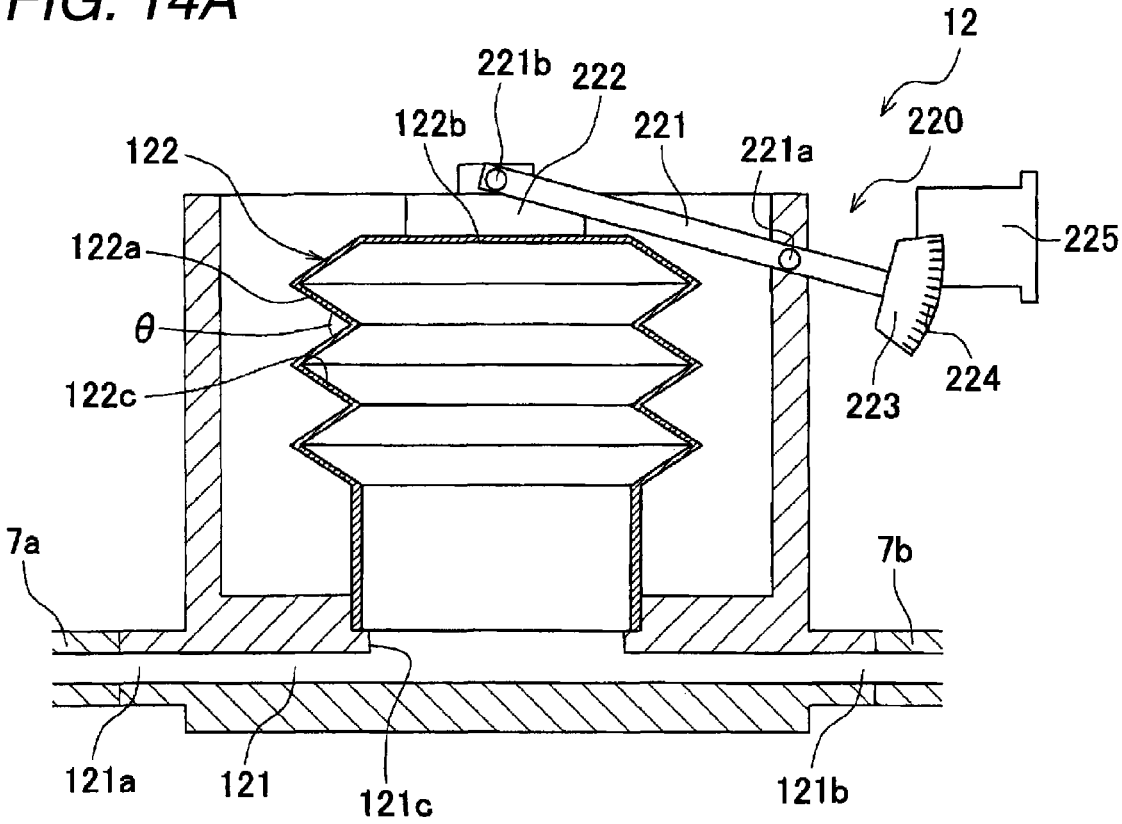
FIGS. 14A and 14B are diagrams illustrating a first modified exemplary embodiment, which correspond to FIGS. 11A and 11B.
Figure 14B:
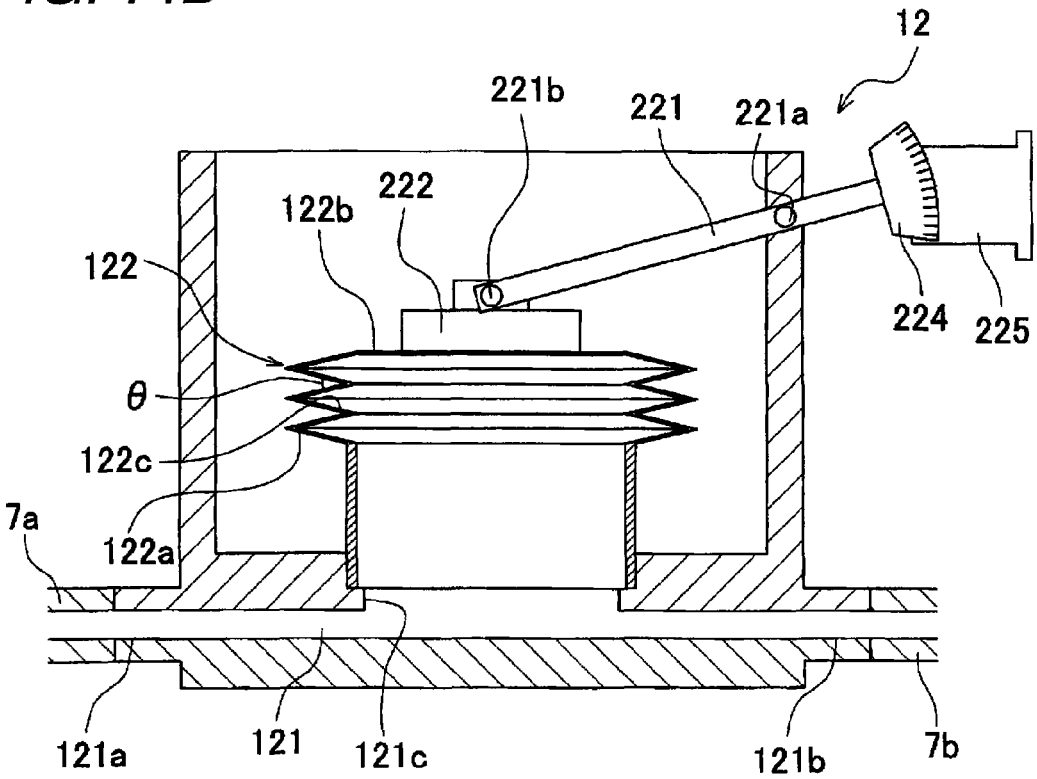

The volume detecting sensor is not limited to that of the above-described exemplary embodiment. In a first modified exemplary embodiment, as shown in FIGS. 14A and 14B, a volume detecting sensor 220 is provided instead of the volume detecting sensor 123 (see FIGS. 11A and 11B). The volume detecting sensor 220 includes a lever 221, a fixed portion 222, a movable plate 223, plural slits 224, and a slit detecting sensor 225.

The lever 221 extends substantially in a straight line and a portion slightly more right than the center portion in FIG. 14A or 14B and a left end portion are rotatably supported by supporting portions 221*a* and 221*b*. The fixing portion 222 is fixed to the top surface of the top wall 122*b* and the supporting portion 221*b* is disposed in the fixed portion 222.

The movable plate 223 has a plate-shape member disposed at the right end of the lever 221 in FIG. 14A or 14B and the right edge in the drawing has a circular arc centered on the supporting portion 221*a*. The plural slits 125 are arranged along the edge of the circular arc shape on the right side of the movable plate 223 in the drawing with a substantially constant interval. The slit detecting sensor 225 is the same as the slit detecting sensor 126 (see FIGS. 11A and 11B) of the above-described exemplary embodiment and detects that the slits 224 pass through the slit detecting sensor 225 in the vertical direction.

In this case, when the pressure of the charge chamber 122*c* is reduced and the top wall 122*b* moves down, the fixed portion 222 moves down along with the top wall 122*b*. Accordingly, the lever 221 rotates about the supporting portion 221*a* and the movable plate 223 located on the opposite side of the fixed portion 222 about the supporting portion 221*a* move up. By allowing the slit detecting sensor 225 to detect that the slits 224 pass through the slit detecting sensor 225, it is possible to detect the volume of the charge chamber 122*c* in plural stages. The movement direction of the slits 224 with the variation in volume of the charge chamber 122*c* is opposite to the movement direction of the slits 125 (see FIGS. 11A and 11B) with the variation in volume of the charge chamber 122*c* in the above-described exemplary embodiment.

In the first modified exemplary embodiment, by changing the ratio of the length between the supporting portions 221*a* and 221*b* of the lever 221 and the length between the supporting portion 221*a* and the movable plate 223, it is possible to change the moving distance of the movable plate 223 (plural slits 224) to the moving distance of the top wall 122*b*, thereby enhancing the degree of freedom in design.

Although the gas permeable film 60 is disposed in the sub-tank 4 in the above-described exemplary embodiment, the inventive concept of the present invention is not limited to the configuration. The gas permeable film may be disposed at any position of the flow channel for supplying the ink from the ink cartridges 6*a* to 6*d* to the ink-jet head 3. For example, in a second modified exemplary embodiment, the discharge unit 23 and the gas permeable film 60 (see FIG. 4) are not disposed in the sub-tank 4, but as shown in FIG. 15, a discharge unit 190 is disposed in the middle way of the tubes 5*a* to 5*d* connecting the ink cartridges 6*a* to 6*d* to the sub-tank 4.

Figure 15:
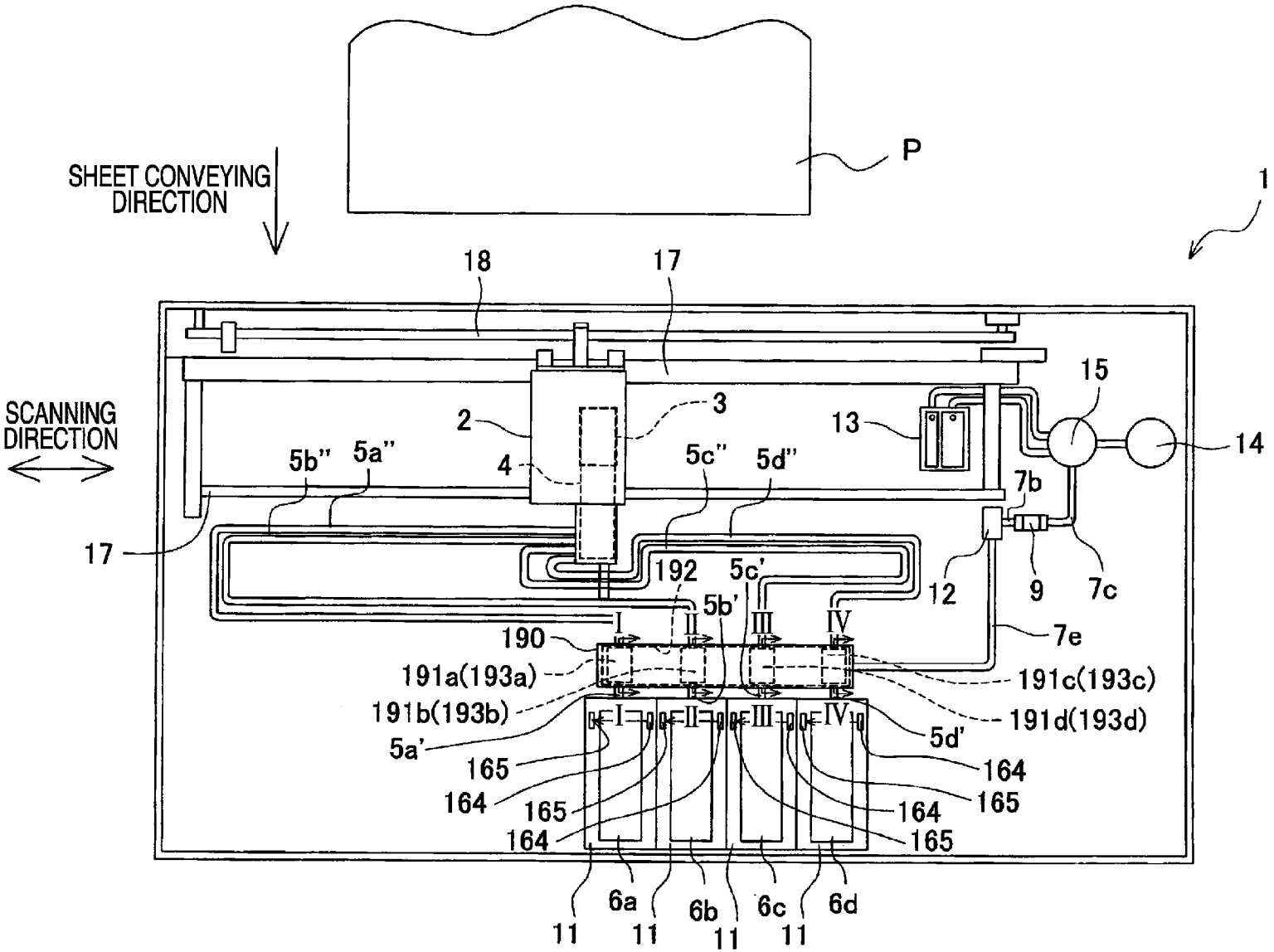
FIG. 15 is a diagram illustrating a second modified exemplary embodiment, which corresponds to FIG. 1.
Figure 16:
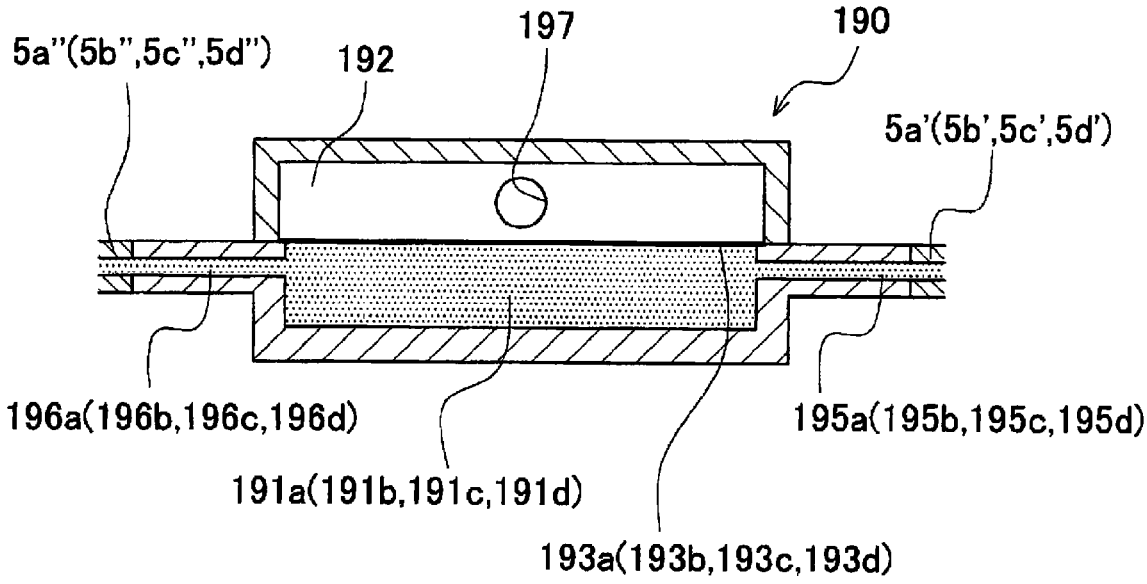
FIG. 16 shows a sectional view taken along line I-I, II-II, III-III or IV-IV of FIG. 15.

FIG. 16 shows a sectional view taken along line I-I, II-II, III-III or IV-IV of FIG. 15. However, since these four sectional view are equal to each other, the sectional views are shown as one view in FIG. 16, the reference numerals of the sectional view taken along line I-I of FIG. 15 are not denoted by parentheses, and the reference numerals of the sectional view taken along line II-II, the sectional view taken along line III-III, and the sectional view taken along line IV-IV of FIG. 15 are denoted by parentheses.

As shown in FIGS. 15 and 16, the discharge unit 190 includes ink chambers 191*a* to 191*d*, a gas chamber 192, and gas permeable films 193*a* to 193*d*. The ink chambers 191*a* to 191*d* are connected to the ink cartridges 6*a* to 6*d* through tubes 5*a*' to 5*d*' at communication holes 195*a* to 195*d* disposed at the right end of FIG. 16, respectively, and are connected to the inflow tubes 31*a* to 31*d* (see FIG. 3) of the sub-tank 4 through tubes 5*a*" to 5*d*" at communication holes 196*a* to 196*d* disposed at the left end of FIG. 16.

The gas chamber 192 extends above the ink chambers 191*a* to 191*d* to cover the ink chambers 191*a* to 191*d*. The gas chamber 192 is connected to the tube 7*a* at a communication hole 197 disposed at the right end of FIG. 15, and the gas chamber 192 is connected to the charge tank 12 through the tube 7*e*. The gas permeable films 193*a* to 193*d* are disposed at positions overlapping the ink chambers 191*a* to 191*d* in a plan view, respectively, and form a wall partitioning the ink chambers 191*a* to 191*d* and the gas chamber 192.

In this case, in the discharge unit 190, the gas in the ink chambers 191*a* to 191*d* is discharged to the gas chamber 192 through the gas permeable films 193*a* to 193*d* and is discharge to the tube 7*e* from the gas chamber 192. In the second modified exemplary embodiment, a gas flow channel extending from the gas chamber 192 to the switching unit 15 through the tube 7*e*, the charge tank 12, the tube 7*b*, the differential pressure regulating valve 9, and the tube 7*c* corresponds to the discharge channel.

In the second modified exemplary embodiment, the gas permeable films 193*a* to 193*d* are disposed to correspond to the ink chambers 191*a* to 191*d*, but one gas permeable film may be disposed above the ink chambers 191*a* to 191*d* to cover the ink chambers 191*a* to 191*d*. Alternatively, in the above-described exemplary embodiment, gas permeable films may be individually disposed to correspond to the ink flow channels 47*a* to 47*d* instead of the gas permeable film 60, similarly to the second modified exemplary embodiment.

Although it has been described in the above-described exemplary embodiment that it is detected that the pressure of the discharge channel varies by detecting that the volume of the charge chamber 122*c* of which the volume varies with the variation in pressure of the inside communicating with the discharge channel varies, the inventive concept of the present invention is not limited to the configuration. It may be detected by the use of other methods that the pressure of the discharge channel varies.

Although it has been described in the above-described exemplary embodiment that it is detected that the gas in the ink supply channel is being discharged to the discharge channel by detecting that the pressure of the discharge channel varies, the inventive concept of the present invention is not limited to the configuration. For example, such as detecting that the gas in the ink flow channels 47*a* to 47*d* is being discharged to the individual gas chambers 63*a* to 63*d* through the gas permeable film 60 by disposing an optical sensor in the vicinity of the ink flow channels 47*a* to 47*d* and the individual gas chambers 63*a* to 63*d* of the sub-tank 4 and detecting that the gas moves by the use of the optical sensor, other methods may be used to detect that the gas in the ink supply channel is being discharged to the discharge channel.

A switching device connecting the discharge channel to the switching unit 15 at the time of suctioning the gas in the discharge channel by the use of the suction pump 14 and blocking the connection between the discharge channel and the switching unit 15 at the time of not suctioning the gas in the discharge channel by the use of the suction pump 14 may be disposed in the differential pressure regulating valve 9 of the above-described exemplary embodiment.

Although it has been described in the above-described exemplary embodiment that the target pressure P2 is set to be lower than the normal pressure when a printing operation is not performed in a predetermined time, when one of the ink cartridges 6*a* to 6*d* is replaced, and when the amount of ink remaining in one ink containing chamber 151 of the ink cartridges 6*a* to 6*d* is smaller than a predetermined amount, the target pressure P2 may be changed in some cases thereof.

Although it has been described in the above-described exemplary embodiment that the normal target pressure P2 is slowly reduced with the lapse of time, the normal target pressure P2 may be kept constant.

In the above-described exemplary embodiment, it is detected from the detection result of the volume detecting sensor 123 that the gas in the ink channels 47*a* to 47*d* is being discharged to the individual gas chambers 63*a* to 63*d* through the gas permeable film 60 by the use of the discharge detector 174 and the pressure of the discharge channel is calculated from the detection result of the volume detecting sensor 123 by the pressure calculator 175. However, the pressure calculator 175 may not be provided and the discharge detector 174 may detect from the detection result of the volume detecting sensor 123 only that the gas in the ink flow channels 47*a* to 47*d* are being discharged to the individual gas chambers 63*a* to 63*d* through the gas permeable film 60.

Although it has been described above that the invention is applied to a printer ejecting ink from the nozzles, the invention may be applied to liquid ejecting devices ejecting liquids other than ink from nozzles.

What is claimed is:

1. A liquid ejecting device comprising:

a liquid ejecting head including a nozzle for ejecting a liquid;

a liquid supply channel connected to the liquid ejecting head to supply the liquid to the liquid ejecting head;

a discharge channel connected to the liquid supply channel through a connecting portion to discharge a gas in the liquid supply channel;

a gas permeable film disposed in the connecting portion between the liquid supply channel and the discharge channel, the gas permeable film configured to pass the gas and to not pass the liquid, the gas permeable film partitioning the liquid supply channel and the discharge channel;

a suction unit connected to the discharge channel to communicate therewith and configured to suction a gas in the discharge channel to reduce a pressure therein;

a switching unit configured to block the communication of the discharge channel with the suction unit when the gas in the discharge channel is not suctioned by the suction unit; and a discharge detecting unit configured to detect that the gas in the liquid supply channel is suctioned and discharged to the discharge channel by the reduced pressure in the discharge channel when the communication of the discharge channel with the suction unit is blocked by the switching unit, wherein the discharge detecting unit detects that the gas in the liquid supply channel is discharged to the discharge channel by detecting a variation in the pressure of the discharge channel.

2. The liquid ejecting device according to claim 1, further comprising a head controller configured to control the liquid ejecting head, wherein the head controller controls the liquid ejecting head not to eject the liquid from the nozzle while the discharge detecting unit detects that the gas in the liquid supply channel is discharged to the discharge channel.

3. The liquid ejecting device according to claim 1, wherein the switching unit includes a differential pressure regulating valve disposed in a middle way of the discharge channel and permitting only a flow in the discharge channel in a direction from the gas permeable film to the suction unit, and wherein the differential pressure regulating valve is opened with a suction force of the suction unit to allow the discharge channel to communicate with the suction unit while the gas in the discharge channel is being suctioned by the suction unit, and blocks the communication of the discharge channel with the suction unit when the suction of the suction unit is stopped after the gas is suctioned until the pressure of the discharge channel becomes a predetermined pressure smaller than an atmospheric pressure.

4. The liquid ejecting device according to claim 1, further comprising a volume varying chamber communicating with the discharge channel and varying in volume with the variation in the pressure of the discharge channel, wherein the discharge detecting unit detects the variation in the pressure of the discharge channel by detecting a variation in the volume of the volume varying chamber.

5. The liquid ejecting device according to claim 4, wherein the discharge detecting unit includes volume detecting unit configured to detect the volume of the volume varying chamber in a plurality of stages, and wherein the discharge detecting unit detects the variation in the volume of the volume varying chamber by detecting the stage of the volume of the volume varying chamber detected by the volume detecting unit.

6. The liquid ejecting device according to claim 5, further comprising a pressure calculating unit configured to calculate the pressure of the discharge channel in a plurality of stages from the volume of the volume varying chamber detected by the volume detecting unit.

7. The liquid ejecting device according to claim 6, further comprising a target pressure determining unit configured to determine a target pressure for the pressure of the discharge channel when the suction unit suctions the gas in the discharge channel to reduce the pressure of the discharge channel, the target pressure being lower than an atmospheric pressure, wherein the suction unit suctions the gas in the discharge channel so that the pressure of the discharge channel calculated by the pressure calculating unit gets close to the target pressure determined by the target pressure determining unit.

8. The liquid ejecting device according to claim 7, further comprising a non-ejection time detecting unit configured to detect a time period when the liquid is not ejected from the nozzle of the liquid ejecting head, wherein when the time period detected by the non-ejection time detecting unit is greater than a predetermined time, the target pressure determining unit determines the target pressure to be lower than that when the time period detected by the non-ejection time detecting unit is not greater than the predetermined time.

9. The liquid ejecting device according to claim 7, wherein the target pressure determining unit determines the target pressure so that the pressure of the discharge channel decreases with a lapse of time.

10. The liquid ejecting device according to claim 7, further comprising a mounting section on which a liquid cartridge containing the liquid to be supplied to the liquid ejecting head is detachably mounted, wherein when the liquid cartridge is mounted on the mounting section, the liquid cartridge is connected to the liquid supply channel.

11. The liquid ejecting device according to claim 10, wherein when the liquid cartridge is replaced, the target pressure determining unit determines the target pressure to be lower than that before replacing the liquid cartridge and the suction unit suctions the gas in the discharge channel regardless of the value of the pressure calculated by the pressure calculating unit.

12. The liquid ejecting device according to claim 10, further comprising a near-empty detecting unit configured to detect that an amount of the liquid remaining in the liquid cartridge is smaller than a predetermined amount, and wherein when the near-empty detecting unit detects that the amount of the liquid remaining in the liquid cartridge is smaller than the predetermined amount, the target pressure determining unit determines the target pressure to be lower than that before the detection.

13. The liquid ejecting device according to claim 10, further comprising a liquid run-out determining unit configured to determine whether the liquid in the liquid cartridge runs out, wherein the liquid run-out determining unit determines that the liquid in the liquid cartridge runs out when the gas in the discharge channel is suctioned by the suction unit but the pressure of the discharge channel is not lowered to the target pressure determined by the target pressure determining unit.

14. The liquid ejecting device according to claim 1, further comprising a head controller configured to control the liquid ejecting head, wherein the head controller controls the liquid ejecting head not to eject the liquid from the nozzle while the suction unit suctions the gas in the discharge unit.

15. A liquid ejecting device comprising:

a liquid ejecting head including a nozzle for ejecting a liquid;

a liquid supply channel connected to the liquid ejecting head to supply the liquid to the liquid ejecting head;

a discharge channel connected to the liquid supply channel through a connecting portion to discharge a gas in the liquid supply channel;

a gas permeable film disposed in the connecting portion between the liquid supply channel and the discharge channel, the gas permeable film configured to pass the gas and to not pass the liquid, the gas permeable film partitioning the liquid supply channel and the discharge channel;

a suction unit connected to the discharge channel to communicate therewith and configured to suction a gas in the discharge channel to reduce a pressure therein;

a switching unit configured to block the communication of the discharge channel with the suction unit when the gas in the discharge channel is not suctioned by the suction unit;

a volume varying chamber communication with the discharge channel and configured to vary in volume with the variation in the pressure of the discharge channel; and a discharge detecting unit configured to detect that the gas in the liquid supply channel is suctioned and discharged to the discharge channel by the reduced pressure in the discharge channel when the communication of the discharge channel with the suction unit is blocked by the switching unit, wherein the discharge detecting unit detects that the gas in the liquid supply channel is discharged to the discharge channel by detecting a volume of the volume varying chamber.

16. A liquid ejecting device comprising:

a liquid ejecting head including a nozzle for ejecting a liquid;

a liquid supply channel connected to the liquid ejecting head to supply the liquid to the liquid ejecting head;

a discharge channel connected to the liquid supply channel through a connecting portion to discharge a gas in the liquid supply channel;

a gas permeable film disposed in the connecting portion between the liquid supply channel and the discharge channel, the gas permeable film configured to pass the gas and to not pass the liquid, the gas permeable film partitioning the liquid supply channel and the discharge channel;

a suction unit connected to the discharge channel to communicate therewith and configured to suction a gas in the discharge channel to reduce a pressure therein;

a switching unit configured to block the communication of the discharge channel with the suction unit when the gas in the discharge channel is not suctioned by the suction unit; and an optical sensor configured to optically detect movement of the gas in the liquid supply channel to detect that the gas in the liquid supply channel is suctioned and discharged to the discharge channel by the reduced pressure in the discharge channel when the communication of the discharge channel with the suction unit is blocked by the switching unit, wherein the discharge detecting unit detects that the gas in the liquid supply channel is discharged to the discharge channel by detecting a volume of a volume varying chamber.

* * * * *